US006527360B2

(12) United States Patent
Otsuki et al.

(10) Patent No.: US 6,527,360 B2
(45) Date of Patent: Mar. 4, 2003

(54) PRINTING WITH SENSOR-BASED POSITIONING OF PRINTING PAPER

(75) Inventors: Koichi Otsuki, Nagano-ken (JP); Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/965,712

(22) Filed: Sep. 25, 2001

(65) Prior Publication Data

US 2002/0070994 A1 Jun. 13, 2002

(30) Foreign Application Priority Data

Sep. 27, 2000 (JP) ..... 2000-294122
Aug. 21, 2001 (JP) ..... 2001-249838

(51) Int. Cl.[7] ..... B41J 29/393; B41J 29/38
(52) U.S. Cl. ..... 347/19; 347/16; 347/14
(58) Field of Search ..... 347/19, 14, 17, 347/105, 37, 39, 8, 16, 23; 402/56, 73

(56) References Cited

U.S. PATENT DOCUMENTS 4,198,642 A 4/1980 Gamblin ..... 347/41
4,364,060 A * 12/1982 Jinnai et al. ..... 347/12
5,140,429 A * 8/1992 Ebinuma et al. ..... 358/296
5,192,141 A 3/1993 Chung et al.
5,291,227 A 3/1994 Suzuki
5,798,773 A * 8/1998 Hiramatsu et al. ..... 347/19
6,318,839 B1 * 11/2001 Elgee ..... 347/37

FOREIGN PATENT DOCUMENTS

EP 1 043 166 A2 * 6/2000 ..... B41J/11/08
JP 06182988 7/1994
JP 112402-14 9/1999
JP 2000-351205 A 12/2000

* cited by examiner

*Primary Examiner*—Hai Pham
*Assistant Examiner*—Charles W. Stewart, Jr.
(74) *Attorney, Agent, or Firm*—Beyer Weaver & Thomas

(57) ABSTRACT

This printer prints images while accurately positioning image data on printing paper. Printing paper P is guided by guides 29*a* and 29*b* and is fed in the course of sub-scanning such that the two side edges thereof are above the left slot 26*a* and right slot 26*b* of a platen 26. A carriage 31 equipped with a photoreflector 33 is brought to the position shown by a broken line. The photoreflector 33 is used to detect the presence of printing paper P in the connection 26*d* between the left slot 26*a* and downstream slot 26*r*. The feeding during sub-scanning is stopped and some of the nozzles above the downstream slot 26*r* start printing images in the upper-edge portion Pf (lower edge in FIG. 1) of the printing paper P when the front edge of the printing paper P is detected by the photoreflector 33.

12 Claims, 26 Drawing Sheets

Fig. 17

| Paper material＼size | A5 | B5 | A4 | B4 |
|---|---|---|---|---|
| P1 | 50 (15,35) | 50 (15,35) | 50 (15,35) | 100 (30,70) |
| P2 | 50 (15,35) | 50 (15,35) | 100 (30,70) | 100 (30,70) |
| P3 | 100 (30,70) | 100 (30,70) | 150 (50,100) | 150 (50,100) |
| P4 | 100 (30,70) | 100 (30,70) | 150 (50,100) | 150 (50,100) |

[lines]

PRINTING WITH SENSOR-BASED POSITIONING OF PRINTING PAPER

BACKGROUND OF THE INVENTION

1. Field of the Invention

The present invention relates to a technique for recording dots on the surface of a recording medium with the aid of a dot-recording head, and more particularly to a technique for printing images while accurately positioning the printing paper.

2. Description of the Related Art

Inkjet printers have recently become popular as computer output devices. FIG. 27 is a side view depicting the periphery of a print head for a conventional inkjet printer. Printing paper P is fed in the direction of arrow A by the upstream paper feed rollers 25*p* and 25*q* disposed upstream of a platen 26*o* and by the downstream paper peed rollers 25*r* and 25*s* disposed downstream of the platen 26*o*, and is stopped at specific positions. The printing paper P is supported on the platen 26*o* while facing the head 28*o*. Numerous ink droplets Ip are ejected from the print head in the direction of a specific position on the platen 26*o* while the printing paper is advanced in small increments in the direction of arrow A. The ink droplets Ip are deposited on the printing paper P on the platen 26*o*, and images are recorded on the printing paper.

In such printers, images cannot be formed at the intended positions on the printing paper when the printing paper shifts away from the intended position, which is shown by a broken line in FIG. 27. In addition, the image initially designed to be formed near the edges of the printing paper sometimes ends up extending beyond the printing paper. In such cases, the ink droplets end up missing the initially targeted edge portions of the printing paper, deposit on the platen, and soil the printing paper transported over the platen in the next step, as shown in FIG. 27.

It is an object of the present invention to overcome the above-described shortcomings of the prior art and to provide a technique for printing images while accurately positioning the printing paper.

SUMMARY OF THE INVENTION

The present invention envisages adopting the following structure in order to at least partially overcome the above-described shortcomings. This dot-recording device records ink dots on a surface of a print medium with the aid of a dot-recording head provided with a plurality of dot-forming elements for ejecting ink droplets. This dot-recording device comprises: a main scanning unit configured to move the dot recording head relative to the print medium to perform main scanning; a head drive unit configured to drive at least some of the plurality of dot-forming elements to form dots during the main scanning; a sub-scanning unit configured to move the print medium to perform sub-scanning in a sub-scanning direction; a sensor for detecting presence of the print medium at a specific detection point; and a controller configured to control the dot-recording device. The sensor is disposed at a point outside paths of the ink droplets ejected by the plurality of dot-forming elements during the main scanning. Adopting such an embodiment allows the print medium to be accurately positioned, dots to be recorded, and images to be formed on the print medium by detecting the presence of the print medium with the sensor.

The dot-recording device should preferably print images in the following manner. A sub-scan feed is started from a state in which the print medium is absent from the detection point, the sub-scanning being a scanning operation for driving the print medium across the main scanning direction. The sub-scan feed of the print medium is stopped at a specific position of sub-scanning associated with a position where the sensor detects the presence of the print medium. Main scanning is started and ink droplets are ejected from the dot-forming elements after the print medium reaches the specific position of sub-scanning. Printing images in this manner allows the print medium to be positioned by a method in which the arrival of the leading edge of the print medium to a specific detection point is used as reference.

It is preferable that the sensor comprises: a light emitter configured to emit light to the detection point; and a light receiver configured to receive the light reflected by the print medium. With this arrangement, the print medium can be detected by a noncontact technique, and dots can be recorded unimpeded on the print medium.

It is preferable that the sensor is configured to be moved together with the dot-recording head during the main scanning. Adopting such an embodiment removes any interference between the sensor and the dot-recording head during the main scanning.

It is preferable that the sensor is provided proximate to a dot-forming element position along the sub-scanning direction. The dot-forming element is located at a downstream and in the sub-scanning direction among the dot-forming elements used for printing. Adopting such an embodiment allows the presence of a print medium to be detected and the print medium to be positioned in the vicinity of dot-forming elements for printing images along the front edge of the print medium. The; print medium can therefore be accurately positioned relative to the dot-forming elements for printing images along the leading edge of the print medium.

The printing device preferably further comprises a platen configured to support the print medium that is extending in the main scanning direction and is disposed opposite the dot-forming elements at least along part of a main scan path. The platen has a downstream slot extending in the main scanning direction. The downstream slot is disposed at a position opposite a dot-forming element that is located at a downstream end in the sub-scanning direction. The detection point is located inside the downstream slot and within a sub-scanning range containing the plurality of dot-forming elements. Adopting such an embodiment makes it possible to determine that the leading edge of a print medium has reached the opening of the downstream slot, and to allow the dot-forming elements to start recording dots near the leading edge of the print medium.

According to this embodiment, the platen is provided with a lateral slot connected to the downstream slot and is disposed at least in the area in which ink droplets are deposited from the plurality of dot-forming elements in the sub-scanning direction. In addition, the following structure should preferably be adopted. The platen further has a lateral slot. The lateral slot is connected to the downstream slot and extending in a sub-scanning range in which ink droplets are ejected from the plurality of dot-forming elements. The dot-recording device further comprises a guide configured to guide the print medium to be at a specific position in the main scanning direction during the sub-scanning, the specific position being where the print medium is in a main scanning range in which the dot-recording head is moved and where one of side edges of the print medium is above the lateral slot. The detection point is in the area of connection of the lateral slot and the downstream slot. Adopting such an embodiment makes it possible to start recording dots on the print medium upon determining that the leading edge of the print medium is disposed at the opening of the downstream slot and that the side edges are disposed above the openings of the lateral slots.

It is preferable that the lateral slot comprises first and second lateral slots. The first and second lateral slots are configured such that the side edges of the print medium are above the first and second lateral slot when the print medium is set at the specific position. With such an embodiment, one of the side edges of the print medium is disposed above the opening of the second lateral slot when it is determined that the leading edge of the print medium is disposed at the opening of the downstream slot and the other side edge is disposed above the openings of the first lateral slot. The recording of dots on the print medium can be started when the existence of such an arrangement is confirmed.

It is preferable that the sensor is positioned upstream in the sub-scanning direction of a dot-forming element that is located on a downstream end in the sub-scanning direction among the dot-forming elements used for dot recording. Adopting this arrangement allows dots to be formed on a print medium at least by the dot-forming elements disposed along the downstream end in the sub-scanning direction without reversing the sub-scanning after the rear edge of the print medium has been detected by the sensor.

The printing described as follows may be performed in the dot recording device that has the sensor that is disposed upstream or in the vicinity in the sub-scanning direction of a dot-forming element that is located on the downstream end in the sub-scanning direction among the dot-forming elements used for dot recording. In the printing, image data is prepared that allow images to be printed in an image area comprising an area on the print medium and an area extending beyond the rear edge of the print medium. Dot recording is performed according to the image data while performing the main scanning and sub-scanning. The sensor detects the rear edge of the print medium on the detection point. The dot recording is continued according to the image data until the sub-scanning is performed for a predetermined distance after the detecting, to thereby complete the dot recording on the print medium. Adopting this arrangement allows images to be printed by confirming that the rear edge of the print medium has moved past a specific detection position, allowing images to be printed at exact positions in front or behind the rear edge of the print medium.

The dot-recording device should preferably comprise a storage unit for storing the number of main scan lines in which images are to be freshly recorded by main scanning while ink droplets are ejected after the sensor can no longer detect the presence of the print medium. Adopting this arrangement allows images to be printed at exact positions in front or behind the rear edge of the print medium by feeding the print medium in the sub-scanning direction according to the pre-stored feed amount(that is the predetermined distance.)

The number of main scan lines (or the predetermined distance) designated for recording new images after the sensor can no longer detect the presence of the print medium should preferably be established in accordance with material of the print medium. Adopting this arrangement makes it possible to increase the total value of feeding during sub-scanning when the print medium is made of a material characterized by increased slippage during sub-scanning, and to reduce the total value of feeding during sub-scanning when the print medium is made of a material characterized by reduced slippage during sub-scanning.

It is preferable that the predetermined distance depends on size of the print medium. Adopting this arrangement makes it possible to increase the total value of feeding (the predetermined distance) during the sub-scanning of a large print medium, and to reduce the total value of feeding during the sub-scanning of a small print medium.

A dot-recording device preferably further comprises a platen configured to support the print medium. The platen is extending in the main scanning direction, is disposed opposite the dot-forming elements at least along part of a main scan path and has a slot. The is slot extending in the main scanning direction. The width of the slot in the sub-scanning direction corresponding to a specific sub-scanning range on a surface of the dot recording head including at least part of the plurality of dot-forming elements. The detection point is preferably located inside the slot and within a sub-scanning range containing the plurality of dot-forming elements. Adopting this arrangement makes it possible to confirm that the leading edge or the rear edge of the print medium has reached the slot opening, and to record dots on the print medium with the aid of the dot-forming elements disposed opposite the slot.

It is preferable that the slot is an upstream slot extending in the main scanning direction and is disposed at a position opposite a dot-forming element that is located at a upstream edge in the sub-scanning direction. Adopting this arrangement makes it possible to form dots on the rear edge of the print medium over the upstream slot by employing at least the dot-forming elements disposed on the upstream edge in the sub-scanning direction. It is therefore possible to achieve a smooth transition from printing images in the middle portion of the print medium to printing images on the rear edge thereof without resorting to reverse feeding when nozzles other than those disposed opposite the slot are used to print images in the middle portion of the print medium.

The sensor may also be proximate to a slot-facing, dot-forming element position along the sub-scanning direction. The dot-forming element is located on the downstream end. Adopting this arrangement makes it possible to print images by confirming that the rear edge of the print medium has moved past the dot-forming elements used for image printing and disposed opposite the slot. It is thus possible to reduce the area in which ink droplets are ejected beyond the edges of a print medium.

The present invention can be implemented as the following embodiments.

(1) A dot-recording method, print control method, or printing method.

(2) A dot-recording device, print control device, or printing device.

(3) A computer program for operating the device or implementing the method.

(4) A storage medium containing computer programs for operating the device or implementing the method.

(5) A data signal carried by a carrier wave and designed to contain a computer program for operating the device or implementing the method.

BRIEF DESCRIPTION OF DRAWINGS

FIG. 17 is a table depicting the size Rs of an image area Ar in which ink droplets are ejected after the lower edge of a printing paper P has moved past a detection point DP2;

DESCRIPTION OF THE PREFERRED EMBODIMENT

Embodiments of the present invention will now be described through embodiments in the following sequence.

A. Overview of Embodiments

B. First Embodiment

B1. Overall Structure of Device

B2. Arrangement of Printing Paper

B3. Upper-edge Routine

B4. Printing on Left and Right Side Edges

B5. Lower-edge Routine

C. Second Embodiment

C1. Overall Structure of the Device

C2. Setting of Image data

C3. Lower-edge routine

C4. Merits

D. Third Embodiment

E. Modifications

E1. Modification 1

E2. Modification 2

E3. Modification 3

E4. Other

A. Overview of Embodiments

Figure 1:
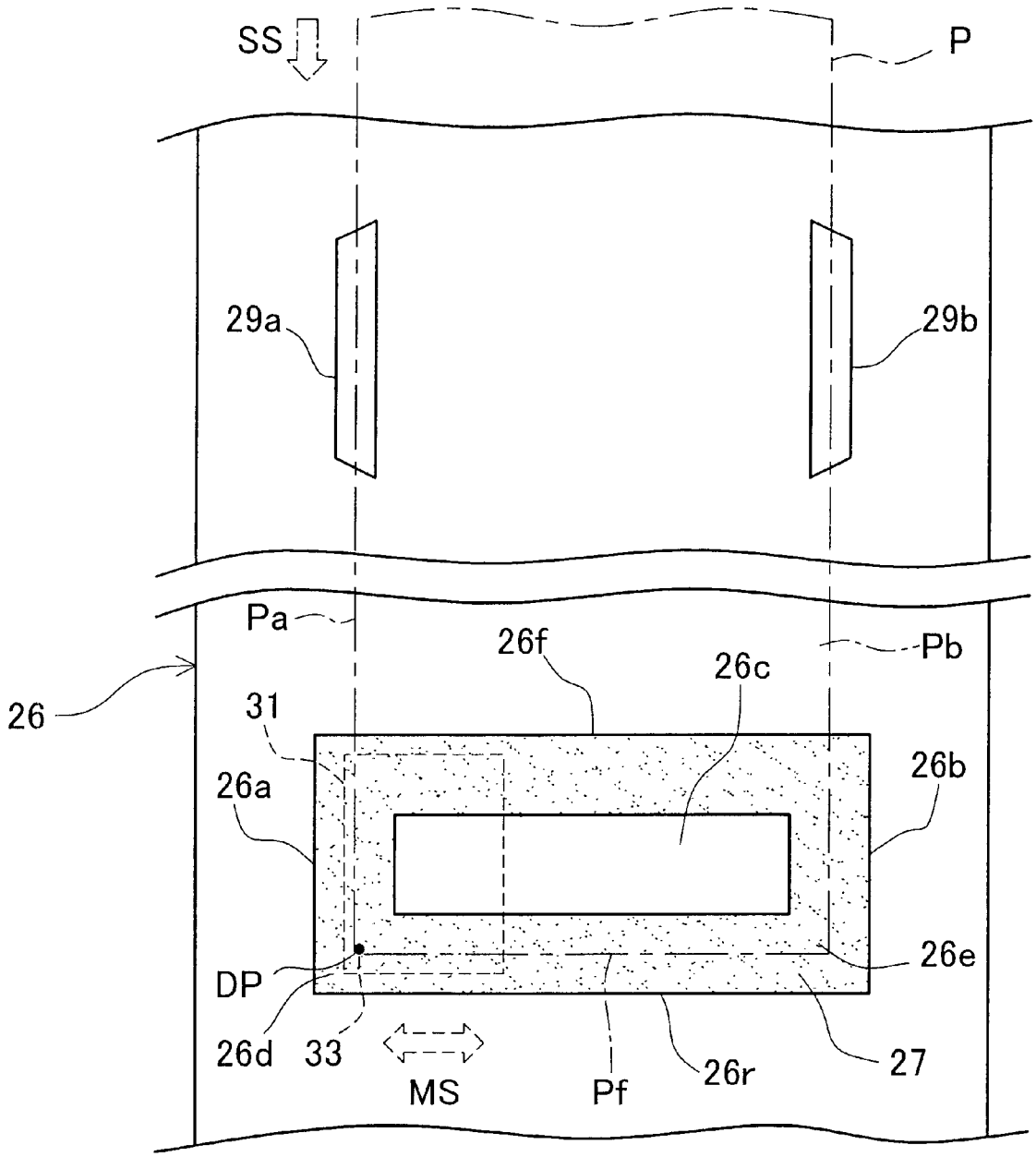
FIG. 1 is a plan view depicting, in simplified form, the structure of the area around the platen provided to an ink-jet printer in accordance with an embodiment of the present invention.

FIG. 1 is a plan view depicting, in simplified form, the structure of the area around the platen provided to an ink-jet printer in accordance with an embodiment of the present invention. In FIG. 1, a printing paper P is fed in the course of sub-scanning from top to bottom in the direction of arrow SS. In the process, the printing paper P is guided by guides 29*a* and 29*b* and is fed in the course of sub-scanning such that the two side edges Pa and Pb thereof pass above the left slot 26*a* and right slot 26*b* of the platen 26. The carriage 31 of the print head is positioned as shown by the broken line when the printing paper P is fed in the course of sub-scanning above the platen 26. The carriage 31 is provided with a photoreflector 33, which is disposed on the surface facing the platen 26. The photoreflector 33 is disposed on the carriage 31 at a position slightly upstream (in the reverse direction relative to arrow SS) from the nozzles on the downstream end in the sub-scanning direction. The photoreflector 33 is used to detect the presence of printing paper P at a specified point DP in the connection 26*d* between the left slot 26*a* and downstream slot 26*r*.

The feeding of the printing paper P during sub-scanning is stopped when the printing paper P is fed in the course of sub-scanning in the direction of arrow SS, and the front edge thereof is detected by the photoreflector 33. The nozzles of the print head that lie above the downstream slot 26*r* start printing images on the upper edge Pf (lower edge in FIG. 1) of the printing paper P. The nozzles of the print head are provided beyond the upper edge Pf of the printing paper P in the direction of arrow SS, and are therefore configured to form images without blank spaces on the upper edge of the printing paper P. In addition, the fact that the nozzles used for printing are disposed above the downstream slot 26*r* allows ink droplets to fall down into the downstream slot 26*r* and prevents these droplets from depositing on the central portion 26*c* of the platen 26 when they miss the printing paper P. The lower surface of the printing paper P is thereby prevented from being soiled by the ink droplets depositing on the central portion 26*c* of the platen 26. Images are printed in the same manner in the left and right edge portions of the printing paper P during main scanning by the nozzles disposed above the left slot 26*a* and right slot 26*b*. It is thus possible to print images without blank spaces on the left and right edges while preventing the central portion 26*c* of the platen 26 from being soiled.

Figure 2:
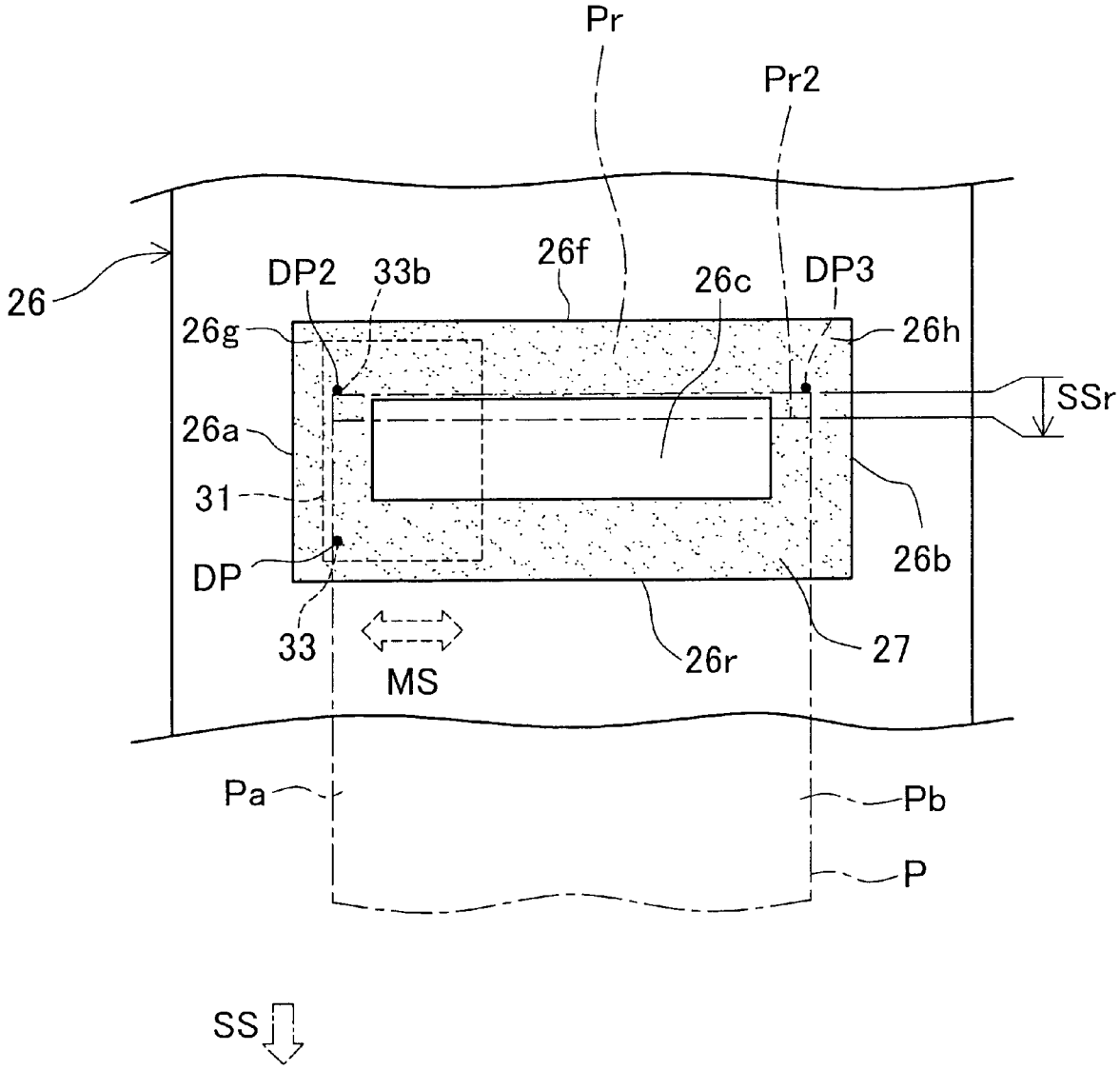
FIG. 2 is a plan view depicting the relation between printing paper P and a platen 26 during printing of images in the lower-edge portion Pr of the printing paper P.

FIG. 2 is a plan view depicting the relation between printing paper P and a platen 26 during printing of images in the lower-edge portion Pr of the printing paper P. In FIG. 2, the: printing paper P is fed in the course of sub-scanning in the direction of arrow SS from top to bottom. The carriage 31 of the print head is provided with a photoreflector 33*b*, which is disposed on the surface facing the platen 26. The position of the photoreflector 33*b* in the sub-scanning direction matches the position of those nozzles facing an upstream slot 26*f* that are disposed on the downstream side in the sub-scanning direction. The photoreflector 33*b* is designed to confirm the presence of printing paper P at a specific point DP2 in the connection area 26*g* between the upstream slot 26*f* and a left slot 26*a*.

Images are printed on the lower edge Pr (upper edge in FIG. 2) of the printing paper P by those nozzles of the print head that are disposed above the upstream slot 26*f*. Main and sub-scanning is continued once a photoreflector 33 confirms that the printing paper P has been fed in the direction of arrow SS and the back end thereof has moved past a point DP2. In the process, the lower end of the printing paper P is advanced to Pr2, as shown by arrow SSr. Images can thus be formed without blank spaces on the lower edge of the printing paper P when the printing paper P is tilted or the impact locations of ink droplets are somewhat shifted. In addition, the nozzles used for printing are disposed above the upstream slot 26*f*, preventing ink droplets from depositing in the central portion 26*c* of the platen 26.

In the present specification, the terms "upper edge (portion)" and "lower edge (portion)" are used to designate the edges of printing paper P corresponding to the top and bottom parts of the image data recorded on the printing paper P, and the terms "front edge (portion)" and "rear edge (portion)" are used to designate the edges of printing paper P corresponding to the direction in which the printing paper P is advanced during sub-scanning in the printer 22. Also in the present invention, the term "upper edge (portion)" corresponds to the front edge (portion), and the term "lower edge (portion)" corresponds to the rear edge (portion) when applied to printing paper P.

B. First Embodiment

B1. Overall Structure of Device

Figure 3:
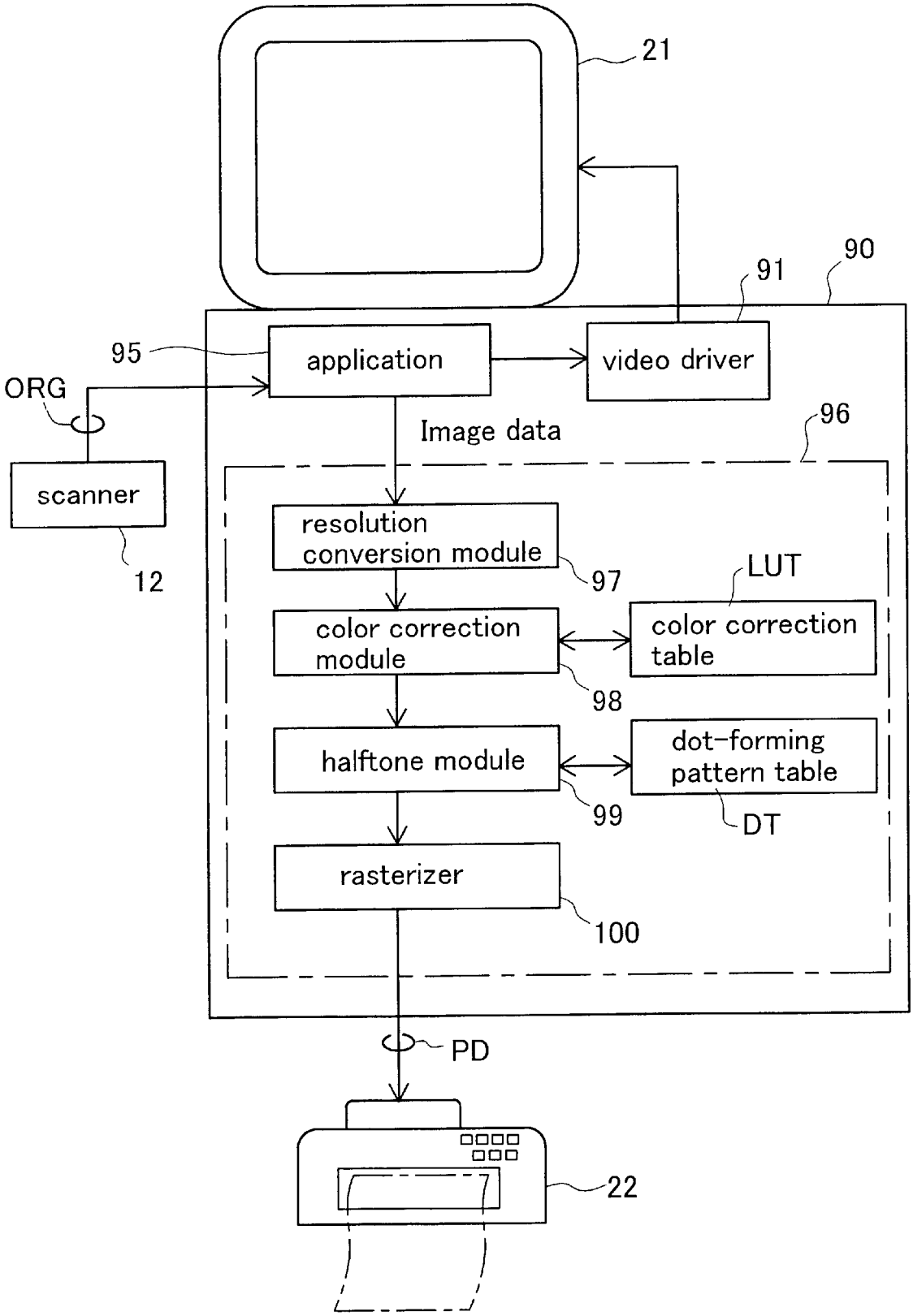
FIG. 3 is a block diagram depicting the structure of the software for the present printing device.

FIG. 3 is a block diagram depicting the structure of the software for the present printing device. In the computer 90, an application program 95 is executed within the framework of a specific operating system. The operating system contains a video driver 91 or a printer driver 96, and the application program 95 outputs the image data D to be transferred to the printer 22 by means of these drivers. The application program 95 for performing video retouching or the like allows images to be read from the scanner 12 and displayed by the CRT 21 by means of the video driver 91 while processed in a prescribed manner. The data ORG presented by the scanner 12 are in the form of primary-color image data ORG obtained by reading a color original and composed of the following three color components: red (R), green (G), and blue (B).

When the application program 95 generates a printing command, the printer driver 96 of the computer 90 receives image data from the application program 95, and the resulting data are converted to a signal that can be processed by the printer 22 (in this case, into a signal containing multiple values related to the colors cyan, magenta, light cyan, light magenta, yellow, and black). In the example shown in FIG. 3, the printer driver 96 comprises a resolution conversion module 97, a color correction module 98, a halftone module 99, and a rasterizer 100. A color correction table LUT and a dot-forming pattern table DT are also stored. The application program 95 corresponds to the image data generator.

The role of the resolution conversion module 97 is to convert the resolution of the color image data handled by the application program 95 (that is, the number of pixels per unit length) into a resolution that can be handled by the printer driver. 96. The resolution conversion module 97 references the expanded area table EAT when the resolution of the image data is converted. The image data are converted to a type of data that allows an image-recording area determined based on data concerning paper types and on an expanded area table EAT (which are provided in advance) to be recorded at a specified resolution. The image-recording area and the expanded area table EAT will be described in detail below.

The function of the resolution conversion module 97 is to allow the controller to prepare image data for printing images in an image area. Specifically, the computer 90 functions, together with the CPU 41 of the printer 22 (see below), as the controller.

Because the image data converted in terms of resolution in this manner are still in the form of video information composed of three colors (RGB), the color correction module 98 converts these data into the data for each of the colors (cyan (C), magenta (M), light cyan (LC), light magenta (LM), yellow (Y), and black (K)) used by the printer 22 for individual pixels while the color correction table LUT is consulted.

The color-corrected data; have a specific gray scale. The printer 22 expresses the gray scale by forming dispersed dots. The halftone module 99 processes the data as a halftone, converting the data to a type that can be expressed the printer 22 as a gray scale in the form of such dots. The halftone module 99 executes the halftone routine upon specifying the dot formation patterns of the corresponding ink dots in accordance with the gray scale of the image data by consulting the dot-forming pattern table DT. The image data thus processed are sorted according to the data sequence to be transferred to the printer 22 by the rasterizer 100, and are outputted as final print data PD. The print data PD contain information about the amount of feed in the sub-scanning direction and information about the condition of dot recording during each main scan. In the present embodiment, the sole role of the printer 22 is to form ink dots in accordance with the print data PD without processing the images, although it is apparent that such processing can also be carried out by the printer 22.

Figure 4:
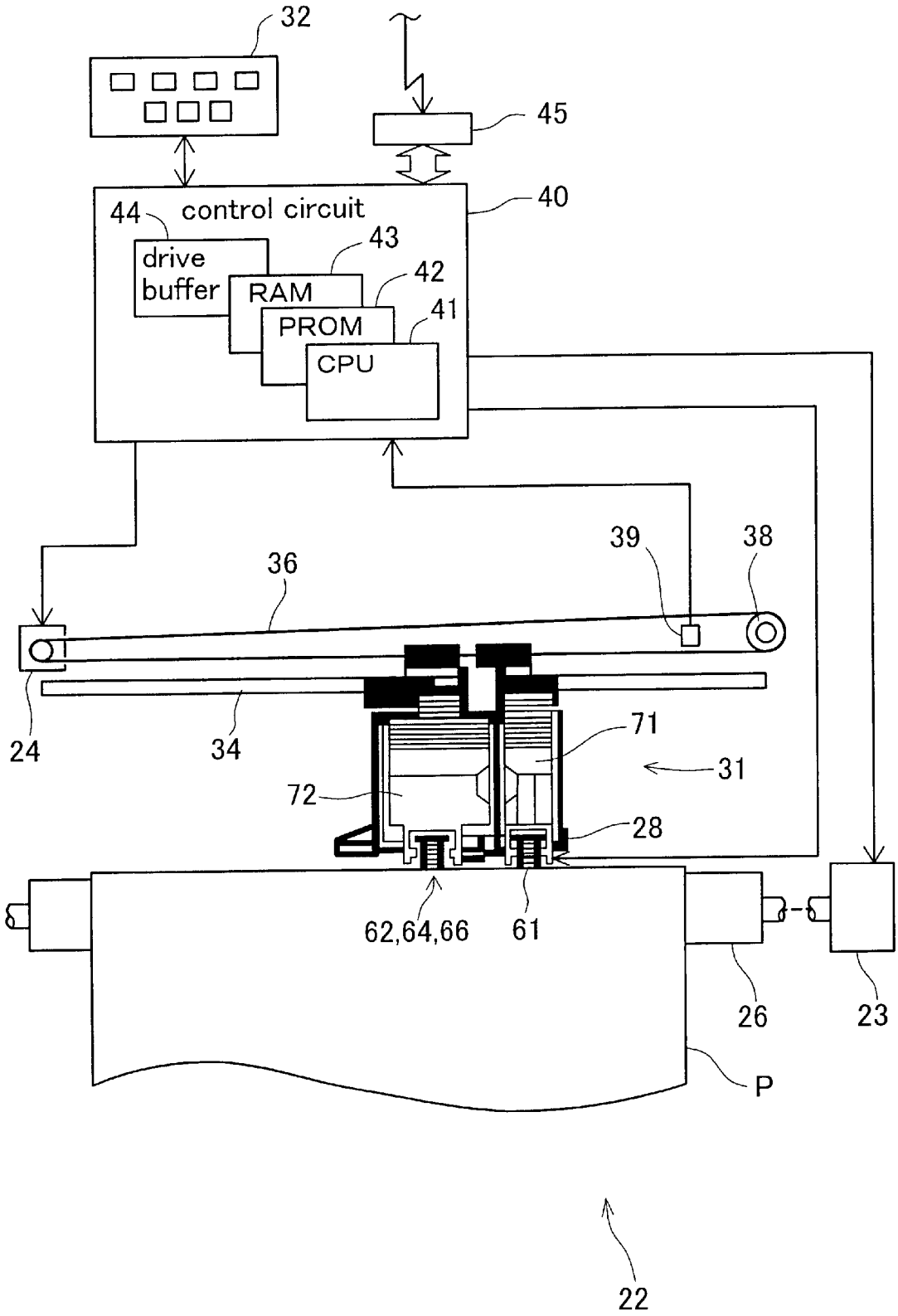
FIG. 4 is a diagram depicting the structure of the mechanical portion of the present printing device.

The overall structure of the printer 22 will now be described with reference to FIG. 4. The printing device includes the computer 90 and the printer 22. As can be seen in the drawing, the printer 22 comprises a mechanism for transporting paper P with the aid of a paper feed motor 23; guides 29*a* and 29*b* (not shown in FIG. 4) for guiding the printing paper P during transport; a mechanism for reciprocating a carriage 31 perpendicular to the direction of transport of the printing paper P with the aid of a carriage motor 24; a mechanism for actuating the print head 28 mounted on the carriage 31 and ejecting the ink to form ink dots; and a control circuit 40 for exchanging signals between the paper feed motor 23, the carriage motor 24, the print head 28, and a control panel 32.

The printing medium is not limited to printing paper. The printing medium may be an OHP sheet or cloth. The printing medium may also be something hard as CD-R medium. The printing medium may be something that can be recorded the ink dots by ink droplets.

The mechanism for reciprocating the carriage 31 perpendicular to the direction of transport of the printing paper P comprises a sliding shaft 34 mounted perpendicular to the direction of transport of the printing paper P and designed to slidably support the carriage 31, a pulley 38 for extending an endless drive belt 36 from the carriage motor 24, a position sensor 39 for sensing the original position of the carriage 31, and the like.

The carriage 31 can support a cartridge 71 for black ink (K) and a color-ink cartridge 72 containing inks of the following six colors: cyan (C), light cyan (LC), magenta (M), light magenta (LM), and yellow (Y). A total of six ink-ejecting heads 61 to 66 are formed in the print head 28 in the bottom portion of the carriage 31, and introduction tubes 67 for guiding the ink from the ink tank to each color head are provided to the bottom portion of the carriage 31. Mounting the cartridge 71 for the black (K) ink and the cartridge 72 for the color inks on the carriage 31 causes the introduction tubes 67 to enter the connection holes provided to each cartridge and allows the ink to be fed from the ink cartridges to the ejection heads 61 to 66.

Figure 5:
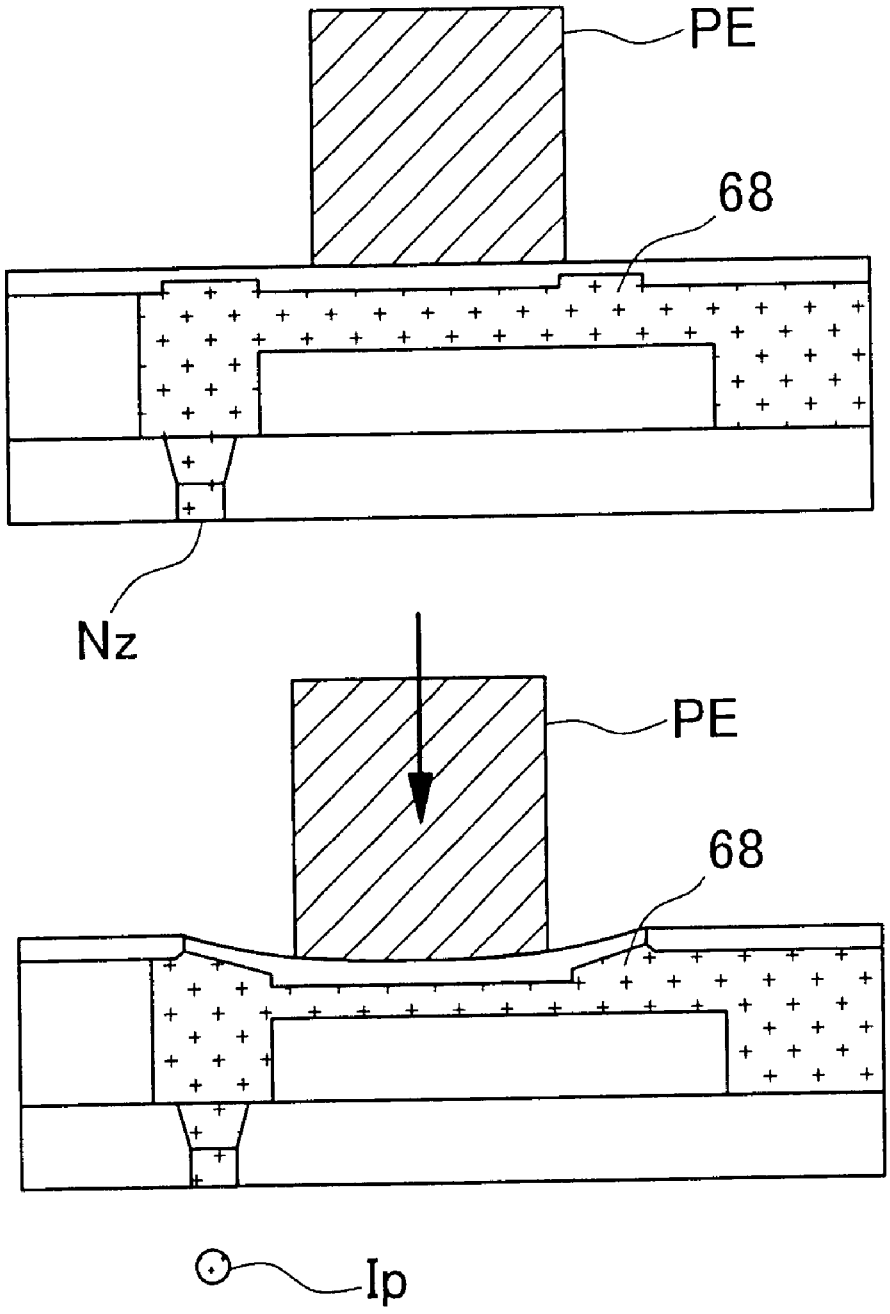
FIG. 5 is a detailed diagram depicting the structure of a piezoelement PE and a nozzle Nz.

FIG. 5 is a detailed diagram depicting the structure of piezoelements PE and nozzles Nz. The color heads 61 to 66 in the bottom portion of the carriage 31 are provided with highly responsive piezoelectric (electrostrictive) elements PE for each nozzle. The piezoelements PE are disposed at locations adjacent to the ink conduits 68 for guiding the ink to the nozzles Nz, as shown in the upper portion of FIG. 5. As is well known, a piezoelement PE changes its crystal structure under the application of voltage, and very rapidly converts electrical energy to mechanical energy. In the present embodiment, applying a voltage for a prescribed period between the electrodes disposed at both ends of a piezoelement PE causes the piezoelement PE to expand during the application of voltage, and deforms the lateral wall of the corresponding ink conduit 68, as shown in the lower portion of FIG. 5. As a result, the volume of the ink conduit 68 decreases in accordance with the expansion of the piezoelement PE, the ink forms particles Ip in proportion to this contraction, and the particles are ejected at a high speed from the tip of the corresponding nozzle Nz. Images are printed as a result of the fact that the ink particles Ip penetrate into the paper P mounted on the platen 26.

Figure 6:
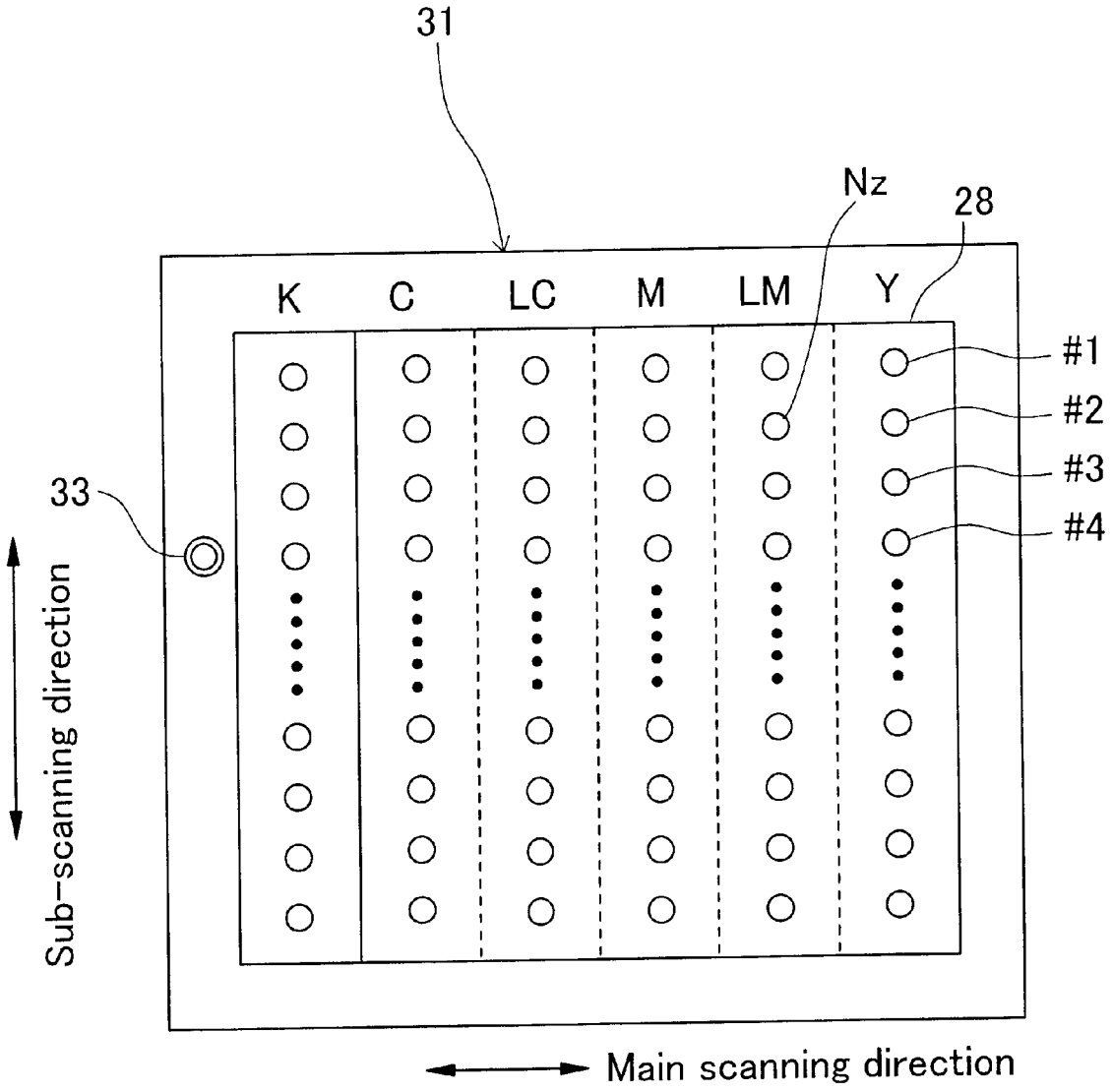
FIG. 6 is a plan view depicting the arrangement of the nozzle units of each color in a print head unit 60.

FIG. 6 is a diagram depicting the arrangement of the ink-jet nozzles Nz in the ink-ejecting heads 61-66. These nozzles form six nozzle arrays for ejecting the ink of each color (black (K), cyan (C), light cyan (LC), magenta (M), light magenta (LM), and yellow (Y)), and the 48 nozzles of each array form a single row at a constant pitch k. Nozzle pitch is the value equal to the number of main scan lines (that is, the number of pixels) that fit into an interval between the nozzles mounted on the print head in the sub-scanning direction. As used herein, the term "main scan line" refers to a row of pixels arranged in the main scanning direction. The term "pixel" refers to a single square of an imaginary grid formed on a print medium in order to define the positions at which dots are recorded by the deposition of ink droplets. For example, nozzles whose intervals correspond to three interposed raster lines have a pitch k of 4.

A photoreflector 33 is provided to the lower surface of the carriage 31 at the same position as nozzle No. 4 in the sub-scanning direction. In preferred practice, the photoreflector 33 may be disposed in the vicinity of nozzle No. 1, which is positioned at the downstream end in the sub-scanning direction, as shown in FIG. 6.

When used in relation to a nozzle moved in the sub-scanning direction, the term "vicinity" or "proximate" refers to a region that covers $1/5^{th}$ of the area in which nozzles are mounted in the sub-scanning direction around the nozzle in question. In the particular example of the present embodiment, in which the print head is provided with a total of 48 nozzles, the photoreflector 33 should preferably be provided within a region extending from the position occupied by nozzle No. 1 to the position occupied by nozzle No. 11. Placing the photoreflector at a position several times the nozzle pitch upstream of nozzle No. 1 is particularly referred. Adopting this arrangement allows dots to be formed on the front edge of printing paper by the nozzles disposed facing the slot.

Figure 7:
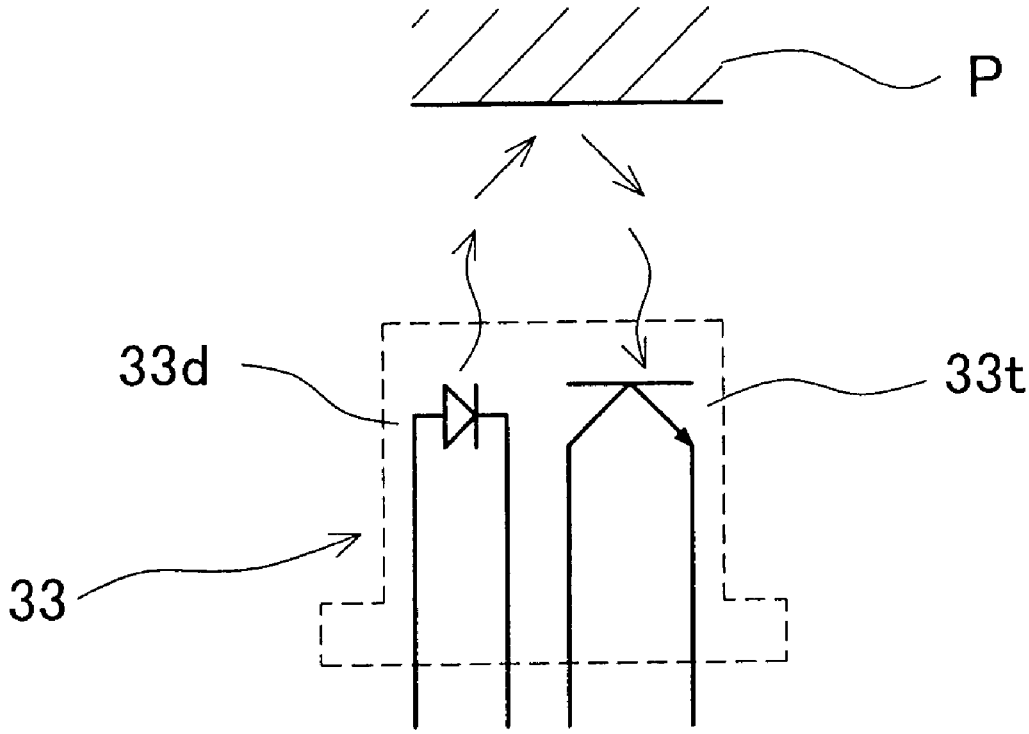
FIG. 7 is a diagram depicting the electrical structure of a photoreflector.

FIG. 7 is a diagram depicting an electric diagram of the photoreflector. The photoreflector 33 is obtained by integrating a light-emitting diode 33*d* and a phototransistor 33*t*, as shown in FIG. 7. The light-emitting diode 33*d* 10 emits light toward a specific detection point, whereas the phototransistor 33*t* receives reflected light and converts luminous energy variations to electric current variations. Depending on whether the light reflected by the printing paper P has been received by the phototransistor 33*t*, the CPU 41 in the control circuit 40 determines whether part of the printing paper P has reached the detection point.

The photoreflector 33 corresponds to the sensor. The light-emitting diode 33*d* corresponds to a light emitter, and the phototransistor 33*t* corresponds to a light receiver. The light emitter may be any device capable of emitting light toward a specific detection point, such as a laser. The light receiver may be any device capable of receiving reflected light from the print medium, such as a photodiode.

Figure 8:
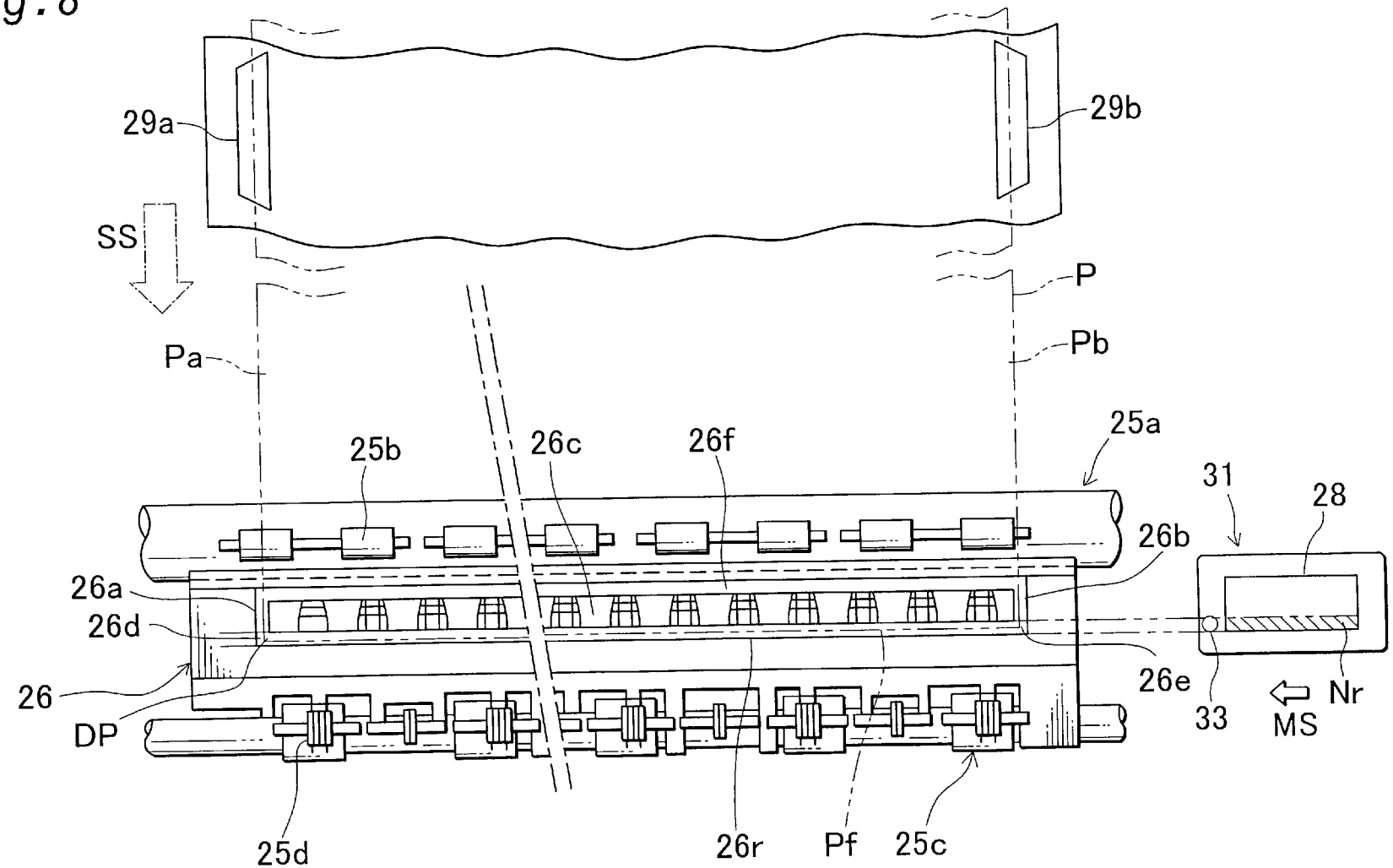
FIG. 8 is a plan view depicting the periphery of the platen 26.

FIG. 8 is a plan view depicting the periphery of the platen 26. The length of the platen 26 is made greater than the width of the printing paper P in the main scanning direction MS in order to extend the platen opposite all the nozzles of the print head 28 in the sub-scanning direction. Upstream paper feed rollers 25*a* and 25*b* are provided upstream of the platen 26. Whereas the upstream paper feed roller 25*a* is a single drive roller, the upstream paper feed roller 25*b* comprises a plurality of freely rotating small rollers. Downstream paper feed rollers 25*c* and 25*d* are also provided downstream of the platen. The downstream paper feed roller 25*c* comprises a plurality of rollers on a drive shaft, and the downstream paper feed roller 25*d* comprises a plurality of freely rotating small rollers. Slots parallel to the axis of rotation are formed in the external peripheral surface of the downstream paper feed roller 25*d*. Specifically, the downstream paper feed roller 25*d* has radial teeth (portions between slots) in the external peripheral surface thereof and appears to be shaped as a gear when viewed in the direction of the axis of rotation. The downstream paper feed roller 25*c* and upstream paper feed roller 25*a* rotate synchronously at the same peripheral speed.

The print head 28 moves back and forth in the main scanning direction over the platen 26 sandwiched between the upstream paper feed rollers 25*a* and 25*b* and the downstream paper feed rollers 25*c* and 25*d*. The printing paper P is held by the upstream paper feed rollers 25*a* and 25*b* and the downstream paper feed rollers 25*c* and 25*d*, and an intermediate portion thereof is supported by the upper surface of the platen 26 while disposed opposite the rows of nozzles in the print head 28. The paper is fed in the sub-scanning direction by the upstream paper feed rollers 25*a* and 25*b* and the downstream paper feed rollers 25*c* and 25*d*, and images are sequentially recorded by the ink ejected from the nozzles of the print head 28.

The platen 26 is provided with an upstream slot 26*f* and a downstream slot 26*r*, which are located on the upstream and downstream sides, respectively, in the sub-scanning direction. The width of the upstream slot 26*f* or downstream slot 26*r* in the main scanning direction is greater than the maximum width of the printing paper P that can be accommodated by the printer 22. In addition, absorbent members 27*f* and 27*r* for accepting and absorbing ink droplets Ip are disposed in the bottom portions of the upstream slot 26*f* and downstream slot 26*r*, respectively. The downstream slot 26*r* is disposed opposite those nozzles N of the print head 28 that form a downstream group of nozzles Nr (the hatched group of nozzles in FIG. 8) containing the extreme downstream nozzle. The width of the downstream slot 26*r* is greater than the width of the group of nozzles Nr in the sub-scanning direction. The upstream slot 26*f* is disposed opposite those nozzles of the print head 28 that form an upstream group of nozzles Nf (not shown in FIG. 8) containing the extreme upstream nozzle. The width of the upstream slot 26*f* is greater than the width of the nozzles Nf in the sub-scanning direction.

The nozzle group Nf comprises nozzle Nos. 1–4, and the nozzle group Nr comprises nozzle Nos. 45–48.

The platen 26 further comprises a left slot 26*a* and a right slot 26*b*, which extend in the sub-scanning direction to connect the two corresponding ends of the upstream slot 26*f* and downstream slot 26*r*.

The left slot 26*a* and right slot 26*b* are disposed in an area that extends in the sub-scanning direction beyond the impact area of the ink droplets ejected by the nozzle rows on the print head. The left slot 26*a* and right slot 26*b* are formed such that the distance between the center lines thereof in the main scanning direction is equal to the width of the printing paper P in the main scanning direction. The left slot 26*a* and right slot 26*b* may be configured such that one of the side-edge portions (side-edge portion Pa) of the printing paper P in the main scanning direction is disposed above the left slot 26*a*, and the other side-edge portion (side-edge portion Pb) is disposed above the right slot 26*b* when the printing paper P is brought to a specified main-scan position by the guides 29*a* and 29*b*. It is therefore possible to adopt an arrangement in which the printing paper, when disposed at a specific position in the above-described manner, is arranged such that the side edges of the printing paper P are located further inward from the center lines of the left slot 26*a* and right slot 26*b*, in addition to an arrangement in which the two side edges thereof match the center lines of the left slot 26*a* and right slot 26*b*.

The upstream slot 26*f*, downstream slot 26*r*, left slot 26*a*, and right slot 26*b* are connected to each other, forming a quadrilateral slot. Absorbent members 27 for receiving and absorbing ink droplets Ip are disposed at the bottom thereof The printing paper P passes above the openings of the upstream slot 26*f* and downstream slot 26*r* when fed in the sub-scanning direction by the upstream paper feed rollers 25*a* and 25*b* and the downstream paper feed rollers 25*c* and 25*d*. The printing paper P is placed on the platen 26 and is positioned by the guides 29*a* and 29*b* in the main scanning direction such that the left edge Pa is disposed above the left slot 26*a*, and the right edge Pb is disposed above the right slot 26*b*.

The inner structure of the control circuit 40 (see FIG. 4) belonging to the printer 22 will now be described. The control circuit 40 contains the following units in addition to CPU 41, PROM 42, and RAM 43: a PC interface 45 for exchanging data with the computer 90, a drive buffer 44 for outputting the ON and OFF signals of the ink jet to the ink-ejecting heads 61–46, and the like. These elements and circuits are connected together by a bus. The control circuit 40 receives the dot data processed by the computer 90, temporarily stores them in the RAM 43, and outputs the results to the drive buffer 44 according to specific timing.

In the printer 22 thus configured, the carriage 31 is reciprocated by the carriage motor 24 while paper P is transported by the paper feed motor 23, the piezoelement of each of the nozzle units belonging to the print head 28 is actuated at the same time, ink droplets Ip of each color are ejected, and ink dots are formed to produce multicolored images on the paper P.

In the printer of the present embodiment, the areas near the top and lower edges of printing paper are printed differently from the intermediate area of the printing paper because the upper edge Pf of the printing paper P is printed over the downstream slot 26*r*, and the lower edge Pr is printed over the upstream slot 26*f*. In the present specification, the routine whereby images are printed in the intermediate area of printing paper will be referred to as an "intermediate routine," the routine whereby images are printed in the area near the upper edge of printing paper will be referred to as a "upper edge routine," and the routine whereby images are printed in the area near the lower edge of printing paper will be referred to as a "lower-edge routine."

The nozzles used for the upper-edge routine are disposed opposite the downstream slot 26*r*. The nozzles used for the lower-edge routine are disposed opposite the upstream slot 26*f*. The nozzles for all 48 colors are used for the intermediate routine. Since the nozzles for all 48 colors are used for the intermediate routine, the term "nozzles used for printing" designates 48 nozzles for each color when applied to the present embodiment.

The width of the upstream slot 26*f* and downstream slot 26*r* in the sub-scanning direction can be expressed as follows.

$$W=p\times n+\alpha$$

In the formula, p is a single feed increment in the sub-scanning direction during a top- or lower-edge routine, n is the number of feed increments in the sub-scanning direction during a top- or lower-edge routine, and $\alpha$ is an estimated feed error in the sub-scanning direction during a top- or lower-edge routine. The $\alpha$-value of the lower-edge routine performed over the upstream slot 26*f* should preferably be greater than the $\alpha$-value of the upper-edge routine performed over the downstream slot 26*r*. Specifying the slot width of the platen according to this formula makes it possible to provide the slots with a width sufficient to adequately receive the ink droplets ejected from the nozzles during a top- or lower-edge routine.

B2. Arrangement of Printing Paper

Figure 9:
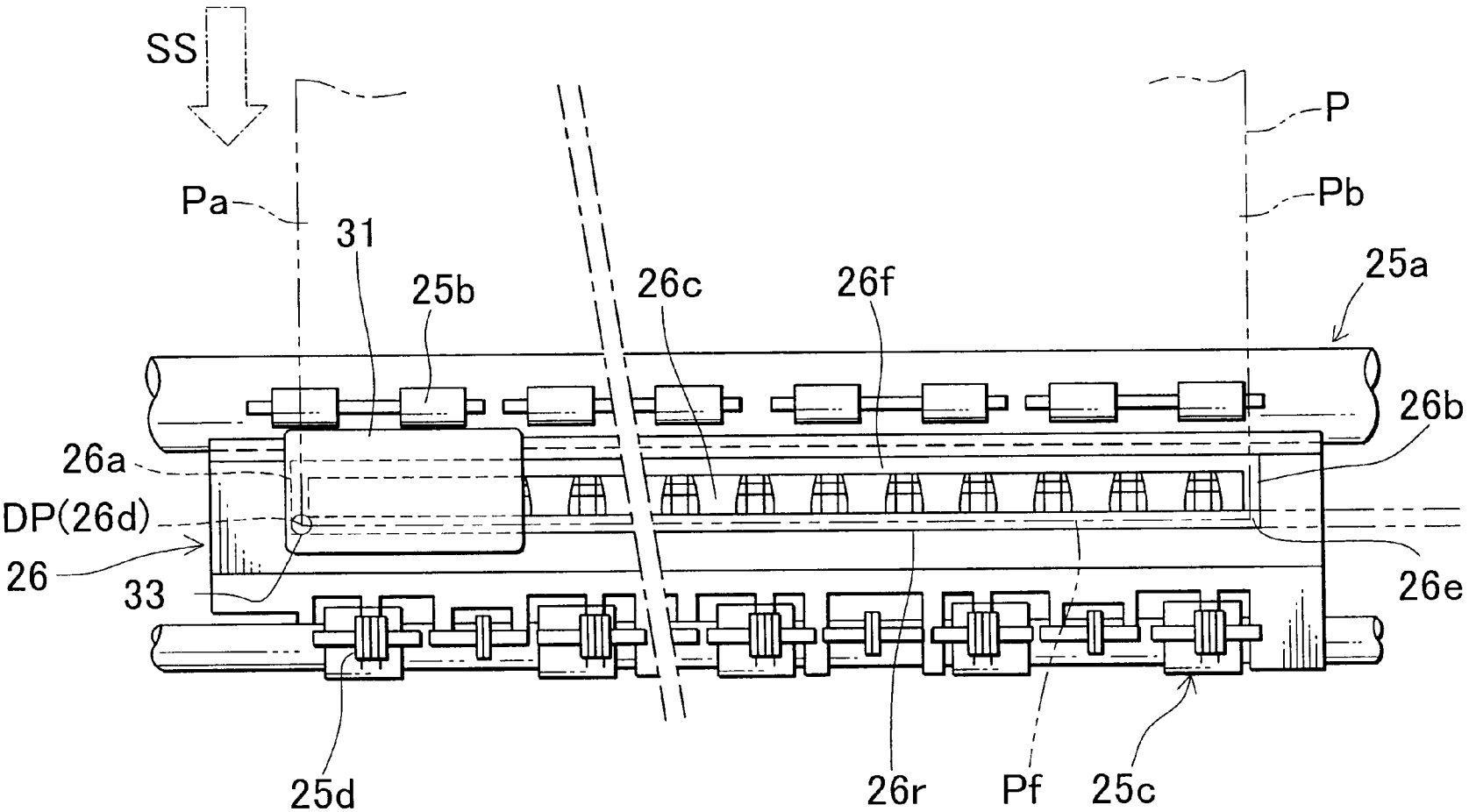
FIG. 9 is a plan view depicting the manner in which units are arranged when the printing paper P is first placed on the platen 26 in an ink-jet printer.

FIG. 9 is a plan view depicting the manner in which units are arranged when the printing paper P is first placed on the platen 26 in an ink-jet printer. In FIG. 9, the printing paper P is fed in the course of sub-scanning in the direction of arrow SS from top to bottom. In the process, the printing paper P is guided by the guides 29*a* and 29*b* (see FIG. 8) and fed in the course of sub-scanning such that the two side edges thereof are disposed above the left slot 26*a* and right slot 26*b* of the platen 26.

The carriage 31 of the print head 28 is located above the platen 26 on the left side when the printing paper P is fed in the course of sub-scanning through the space above the central portion 26*c* of the platen 26, as shown in FIG. 9. When the carriage 31 is in the position shown in FIG. 9, the photoreflector 33 is disposed above a specific detection point DP on the connection 26*d* between the left slot 26*a* and downstream slot 26*r*. In this position, the light-emitting diode 33*d* of the photoreflector 33 can emit light in the direction of the detection point DP. The detection point DP is located at a specific position inside the area for accommodating the nozzles of the print head 28 (a position in the sub-scanning direction). The CPU 41 can detect by means of the photoreflector 33 whether the printing paper P is present at the detection point DP.

Because the photoreflector 33 allows printing paper to be detected by a noncontact method, the result is different from that obtained with a contact sensor in that the subsequent printing can be performed unimpeded. In addition, the photoreflector 33 is installed on the carriage, and thus lies outside the path of ink droplets during main scanning. It is therefore unlikely that the ink will interfere with the process and adversely affect the detection process. Placing the detection point DP of the photoreflector 33 at a specific location inside the nozzle area in the sub-scanning direction allows images to be formed without blank spaces along the leading edge of the printing paper P by ejecting ink droplets from the nozzles after placing the printing paper P near the position occupied by the paper when it was first detected.

The printing paper P is first fed in the direction of arrow SS in the course of sub-scanning from a state in which the printing paper P has not yet reached the platen 26. The feeding of the printing paper P in the course of sub-scanning is stopped once the leading edge thereof is detected by the photoreflector 33. In the present embodiment, the photoreflector 33 is disposed at the position of nozzle No. 4. After the photoreflector 33 has detected the presence of the printing paper P, the CPU 41 advances the paper by a small increment and stops feeding the printing paper in the sub-scanning direction such that the,upper edge Pf of the printing paper P is located (in the sub-scanning direction, which is opposite from the direction of arrow SS) several rasters upstream from the position of the nozzles (referred to hereinbelow as "lower-edge nozzles") located at the downstream end in the sub-scanning direction. Feeding the printing paper P in the course of sub-scanning in this manner allows the paper to be supported by the central portion 26*c* of the platen 26, and brings the upper edge of the paper (in FIG. 9, the upper edge is disposed in the lower half of the drawing) to a point about the downstream slot 26*r*. The left edge Pa of the printing paper P assumes a position above the left slot 26*a*, and the right edge Pb assumes a position above the right slot 26*b*.

The carriage is then transported to the right edge and printing is started, as shown in FIG. 8. Specifically, main scanning is performed while ink droplets are ejected from the nozzles. The CPU 41 sends an error signal to the computer 90 and stops the printing process when the printing paper P is fed in the course of sub-scanning but the photoreflector 33 fails to detect the presence of the printing paper P at the detection point DP.

B3. Upper-edge Routine

In the present embodiment, images are recorded without blank spaces up to the upper edge of printing paper. In the process, the images in the upper edge portion Pf of the printing paper P are recorded by nozzles Nr whose positions correspond to those above the downstream slot 26*r* in the sub-scanning direction. Some of the nozzles Nr (including lower-edge nozzles) are positioned in the sub-scanning direction (in the direction of arrow SS) downstream from the upper edge of the printing paper P, as shown in FIG. 8. In other words, the printing paper P is arranged such that the upper edge Pf of the printing paper P is disposed upstream (in the sub-scanning direction) from lower-edge nozzles.

Consequently, images could theoretically be recorded very close to the upper edge of printing paper by starting dot recording after the printing paper is positioned relative to the print head 28 such that the lower-edge nozzle is disposed exactly at the position occupied by the upper edge of the printing paper. There are, however, cases in which the feed increment errors occur during feeding in the sub-scanning direction. There are also cases in which the direction in which ink droplets are ejected shifts away as a result of a manufacturing error or another factor related to the print head.

In the present embodiment, images are printed in the upper edge portion Pf of the printing paper P by arranging the printing paper P such that the upper edge Pf of the printing paper P is disposed upstream of the lower-edge nozzles. Blank spaces can therefore be prevented from forming along the upper edge of the printing paper when ink droplets deviate from their intended impact positions on the printing paper.

Figure 10:
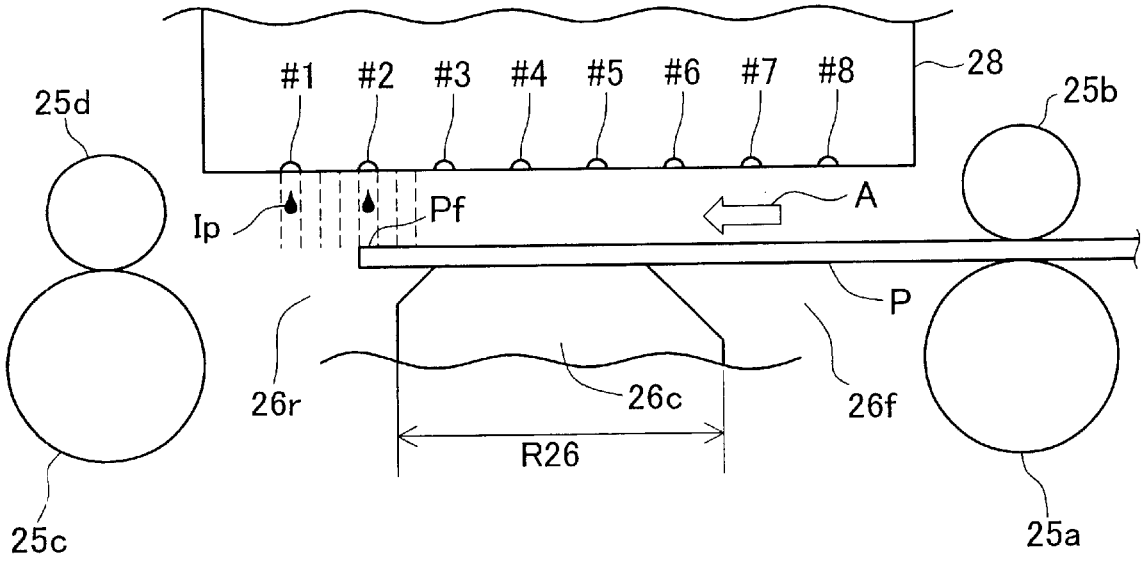
FIG. 10 is a side view depicting the relation between the print head 28 and the printing paper P at the start of printing.

FIG. 10 is a side view depicting the relation between the print head 28 and the printing paper P at the start of printing. For the sake of simplicity, it is assumed that only eight nozzles are used. It is assumed herein that the central portion 26*c* of the platen 26 covers the range R26 extending from a rearward position corresponding to two raster lines (as counted from nozzle No. 2 of the print head 28) to a forward position corresponding to two raster lines (as counted from nozzle No. 7). Consequently, the ink droplets from nozzle Nos. 1, 2, 7, and 8 are prevented from depositing on the platen 26 even when the ink droplets Ip are ejected from the nozzles in the absence of printing paper. In FIG. 8, the nozzles Nr in the hatched portion of the print head 28 correspond to the area in which nozzle Nos. 1 and 2 are disposed. A downstream slot 26*r* is disposed underneath the area over which these nozzles pass during a main scan. Printing is started when the upper edge Pf of the printing paper P is disposed above the downstream slot 26*r*. In the present embodiment, images can be printed without blank spaces in the upper-edge portion of the printing paper P because the upper-edge portion Pf of the printing paper P is printed using nozzle No. 2 (which is positioned directly above the upper-edge portion Pf of the printing paper P) and nozzle No. 1 (which is positioned outside the upper-edge portion Pf of the printing paper P). In addition, the printing paper P can be accurately positioned relative to the nozzles for performing the upper-edge routine because such positioning is done using the photoreflector 33. Ink droplets are also prevented from depositing on the central portion 26*c* of the platen 26 because nozzle Nos. 1 and 2 are disposed above the downstream slot 26*r* when the printing paper shifts its position due to a feeding error occurring during sub-scanning or the like.

Figure 11:
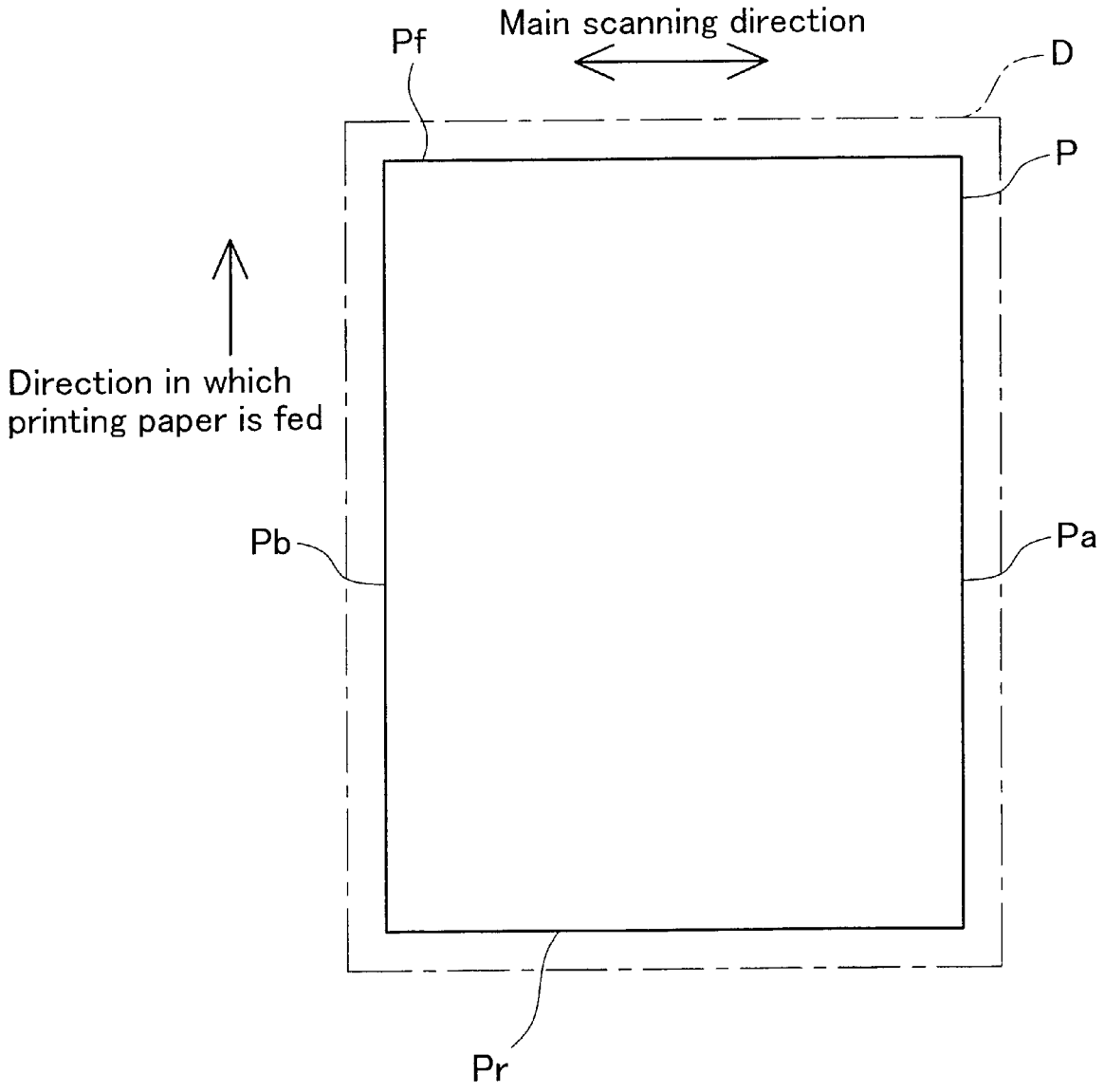
FIG. 11 is a plan view depicting the relation between image data D and the printing paper P.

FIG. 11 is a plan view depicting the relation between image data D and the printing paper P. The present embodiment is such that image data D are provided up to the area outside the printing paper P beyond the upper edge Pf of the printing paper P. The image data D are also provided in the same manner up to the areas outside the printing paper P beyond the edges of the printing paper P for the lower edge Pr, left edge Pa, and right edge Pb. The present embodiment is therefore such that the relation between the image data D and the size of the printing paper P, on the one hand, and the intended position of the image data D and the arrangement of the printing paper P during printing, on the other hand, assumes the configuration shown in FIG. 11. Because the terms "left" and "right" for the left edge Pa and right edge Pb are selected to match the terms "left" and "right" for the printer 22, the actual left and right sides of the printing paper P are the reverse of those designated by the terms "left edge Pa" and "right edge Pb."

B4. Printing on Left and Right Side Edges

Figure 12:
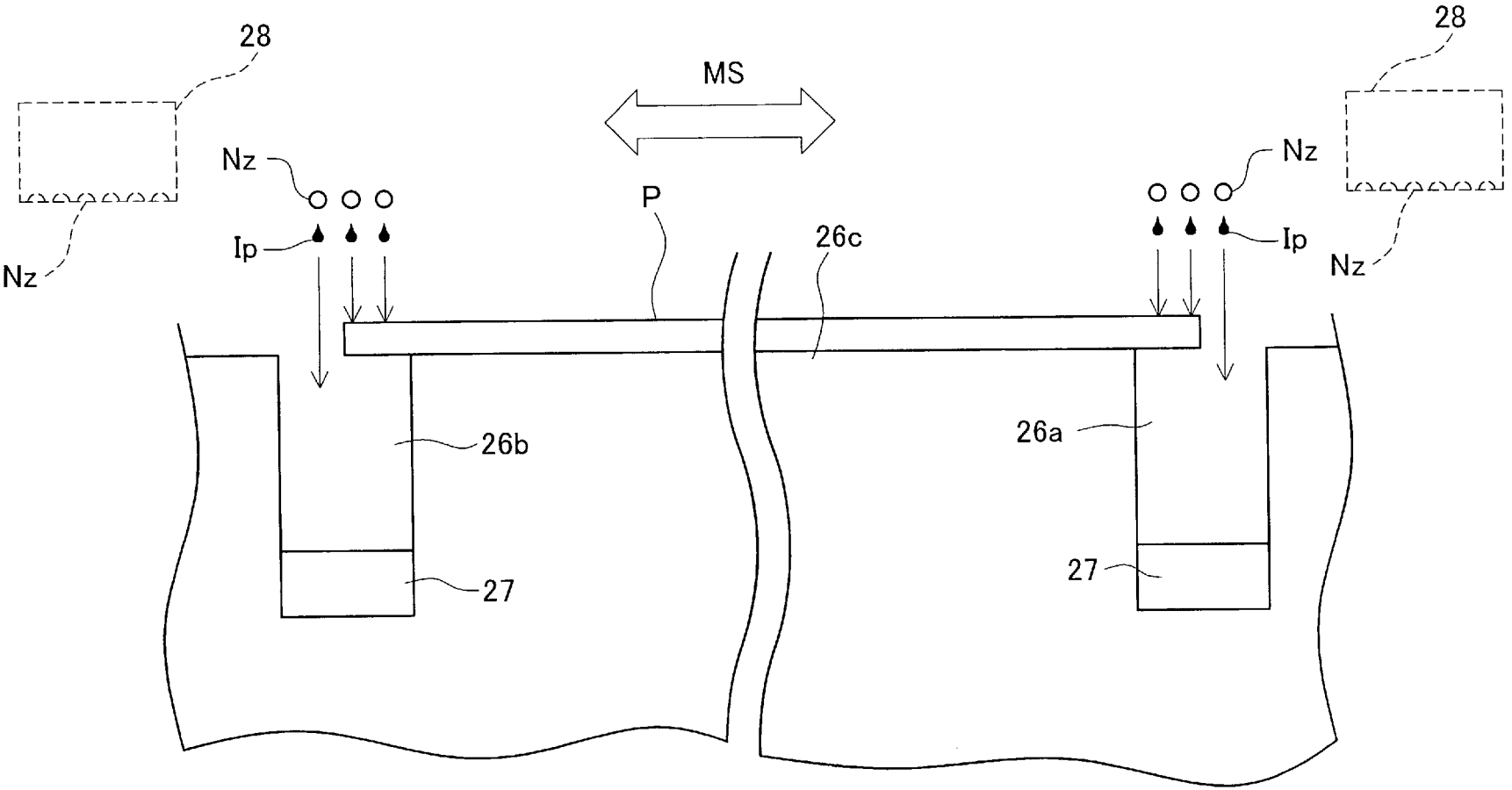
FIG. 12 is a diagram showing the manner in which images are printed in the left and right edge portions of printing paper P.

FIG. 12 is a diagram showing the manner in which images are printed in the left and right edge portions of a printing paper P. In the present embodiment, images are printed without blank spaces in the left and right edge portions of the printing paper P throughout the entire procedure in which images are recorded on the printing paper P, including upper- and lower-edge routines. In the process, the print head 28 is advanced during a main scan such that all its nozzles first move past one of the edges of the printing paper P and reach a position outside the printing paper P, and then move past the other edge of the printing paper P and reach a position outside the printing paper P. Ink droplets are ejected onto the expanded area R in accordance with image data D not only when the nozzles Nz are disposed above the printing paper P but also when the nozzles Nz move past the edges of the printing paper P and reach the area above the left slot 26*a* or right slot 26*b*.

Performing printing in this manner allows images to be formed without blank spaces along the left and right edges of the printing paper P even when the printing paper P shifts somewhat in the main scanning direction. The detection point DP of the photoreflector 33 is located on the connection 26*d* between the left slot 26*a* and downstream slot 26*r*, and printing is suspended when the sensor fails to detect the presence of the printing paper P at the detection point DP, making it possible to print images while keeping the printing paper P correctly positioned in the main scanning direction. Because the nozzles positioned above the left slot 26*a* or right slot 26*b* are designed for printing images in the two edge portions of the printing paper, ink droplets are allowed to deposit in the left slot 26*a* or right slot 26*b* without depositing in the central portion 26*c* of the platen 26 when the ink droplets miss the printing paper P. It is therefore possible to prevent the printing paper P from being soiled by the ink droplets deposited in the central portion 26*c* of the platen 26.

B5. Lower-edge Routine

Figure 13:
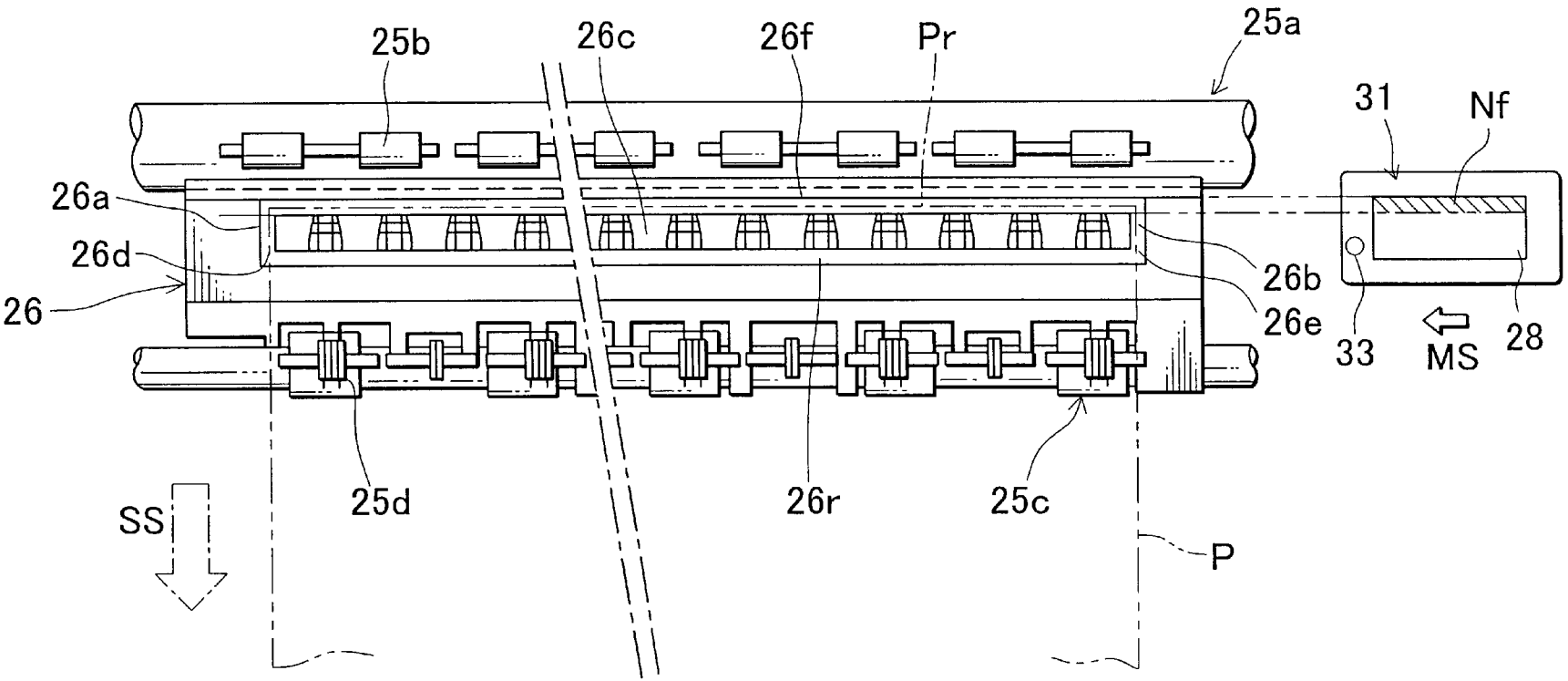
FIG. 13 is a plan view depicting the relation between the printing paper P and the upstream slot 26*f* during the printing of images in the lower-edge portion Pr of the printing paper P.

FIG. 13 is a plan view depicting the relation between the printing paper P and the upstream slot 26*f* during the printing of images in the lower-edge portion Pr of the printing paper P. In the present embodiment, images can be recorded without blank spaces all the way to the lower edge of the printing paper P in the same way as in the case of the upper edge. In FIG. 13, the nozzles Nf in the hatched area of the print head 28 are designed to perform a lower-edge routine. An upstream slot 26*f* is provided underneath the area through which the nozzles travel during main scanning. Images are printed in the lower-edge portion Pr before the printing is completed when the lower edge Pr of the printing paper P is in the position (shown by a dashed line) above the upstream slot 26*f*. In the process, some of the nozzles Nf are disposed upstream (in the sub-scanning direction) from the lower edge (the edge in the upper part of FIG. 13) of the printing paper P.

Theoretically, images can be recorded all the way to the lower edge of the printing paper in the same manner as with the above-described upper-edge routine by recording dots along the lower edge when the most upstream nozzles (referred to hereinbelow as "upper-edge nozzles") in the sub-scanning direction are disposed very close to the lower edge of the printing paper P. In the present embodiment, however, images are printed in the lower-edge portion Pr of the printing paper P when the lower edge of the printing paper P is disposed downstream from the upper-edge nozzles. Blank spaces are therefore prevented from forming along the lower edge of the printing paper when the ink droplets deviate from their intended impact positions on the printing paper.

Figure 14:
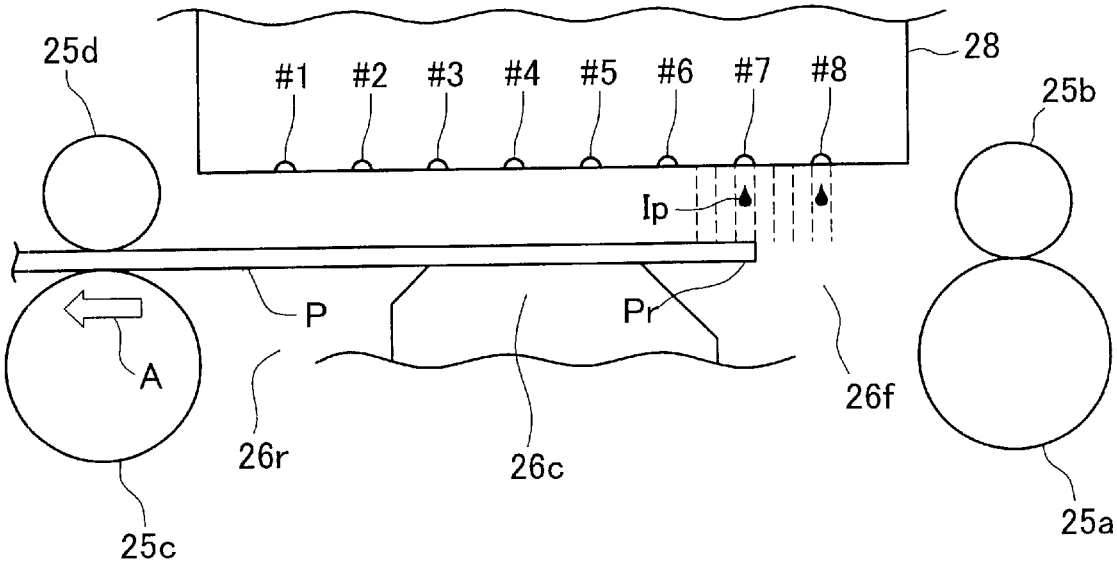
FIG. 14 is a side view depicting the relation between the printing paper P and the print head 28 during the printing of images on the lowermost edge of the printing paper.

FIG. 14 is a side view depicting the relation between the printing paper P and the print head 28 during the printing of images in the lower-edge portion Pr of the printing paper P. When images are printed in the lower-edge portion Pr of the printing paper P, the lower edge Pr of the printing paper P is disposed above the upstream slot 26*f*. The images in the lower-edge portion Pr of the printing paper P are printed using nozzle No. 7 (which is positioned directly above the lower edge Pr) and nozzle No. 8 (which is positioned outside the lower-edge portion Pr of the printing paper P). The printer 22 of the present embodiment can therefore print images without blank spaces in the lower-edge portion Pr of the printing paper P. The printer 22 of the present embodiment also positions the printing paper P with the aid of the photoreflector 33 during the start of printing. The printing paper P can therefore be accurately positioned relative to the nozzles for performing the lower-edge routine as long as the system is accurately fed in the sub-scanning direction after the start of printing. Ink droplets are also prevented from depositing on the central portion 26*c* of the platen 26 because nozzle Nos. 7 and 8 are disposed above the upstream slot 26*f* when the printing paper shifts its position due to a feeding error occurring during sub-scanning or the like.

C. Second Embodiment

C1. Overall Structure of the Device

Figure 15:
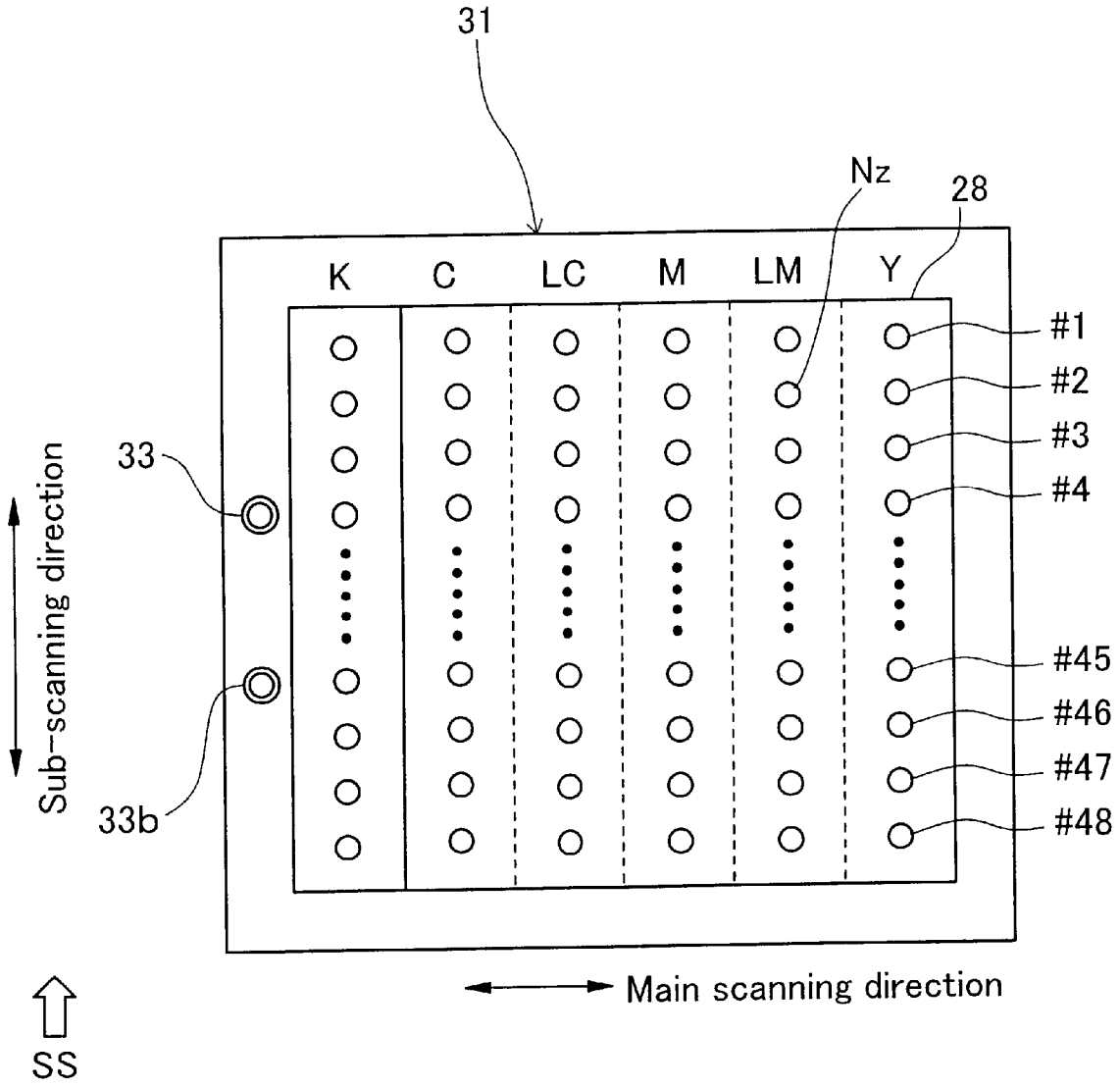
FIG. 15 is a diagram depicting an arrangement of photoreflectors 33 and 33*b* and ink-jet nozzles Nz in a print head unit 60.

FIG. 15 is a diagram depicting an arrangement of photoreflectors 33 and 33*b* and ink-jet nozzles Nz in a print head unit 60. The photoreflector 33*b* is provided to the bottom surface of the carriage 31 at the same position as that occupied by nozzle No. 45 in the sub-scanning direction, as shown in FIG. 15. Other hardware structure of the device in the Second is the same as that of First Embodiment. In Second Embodiment, the printing procedure is also the same as that of First Embodiment except preparing printing data and the lower-edge routine.

The photoreflector 33*b* has the same functions and structure as the photoreflector 33 (see FIG. 7). Whereas the photoreflector 33 can confirm the presence of printing paper P at a specific detection point DP in the connection area 26*d* between the left slot 26*a* and the downstream slot 26*r* when the carriage 31 is in the position shown in FIG. 2, the photoreflector 33*b* can confirm the presence of the printing paper P at a specific detection point DP2 in the connection area 26*g* between the left slot 26*a* and the upstream slot 26*f* (see FIG. 2). The upstream slot 26*f* is disposed opposite nozzle Nos. 45–48. Consequently, the detection point DP2 is disposed at a specific position inside the upstream slot 26*f*. This position is located within a region in which the nozzles of the print head 28 are arranged at selected positions in the sub-scanning direction.

Although it was assumed herein that the photoreflector 33*b* is aligned with nozzle No. 45, which is located on the downstream end and is selected from the nozzles that face the upstream slot 26*f*, it is also possible to place the photoreflector 33*b* in the vicinity of, or downstream from, nozzle No. 48, which is located on the upstream edge in the sub-scanning direction. For example, the photoreflector 33*b* may also be disposed at a position several times the nozzle pitch upstream of nozzle No. 48. In FIG. 15, "upstream" and "downstream" are the reverse of the upward and downward directions shown in the drawing because the printing paper is fed in the direction of arrow SS.

C2. Setting of Image Data

Figure 16:
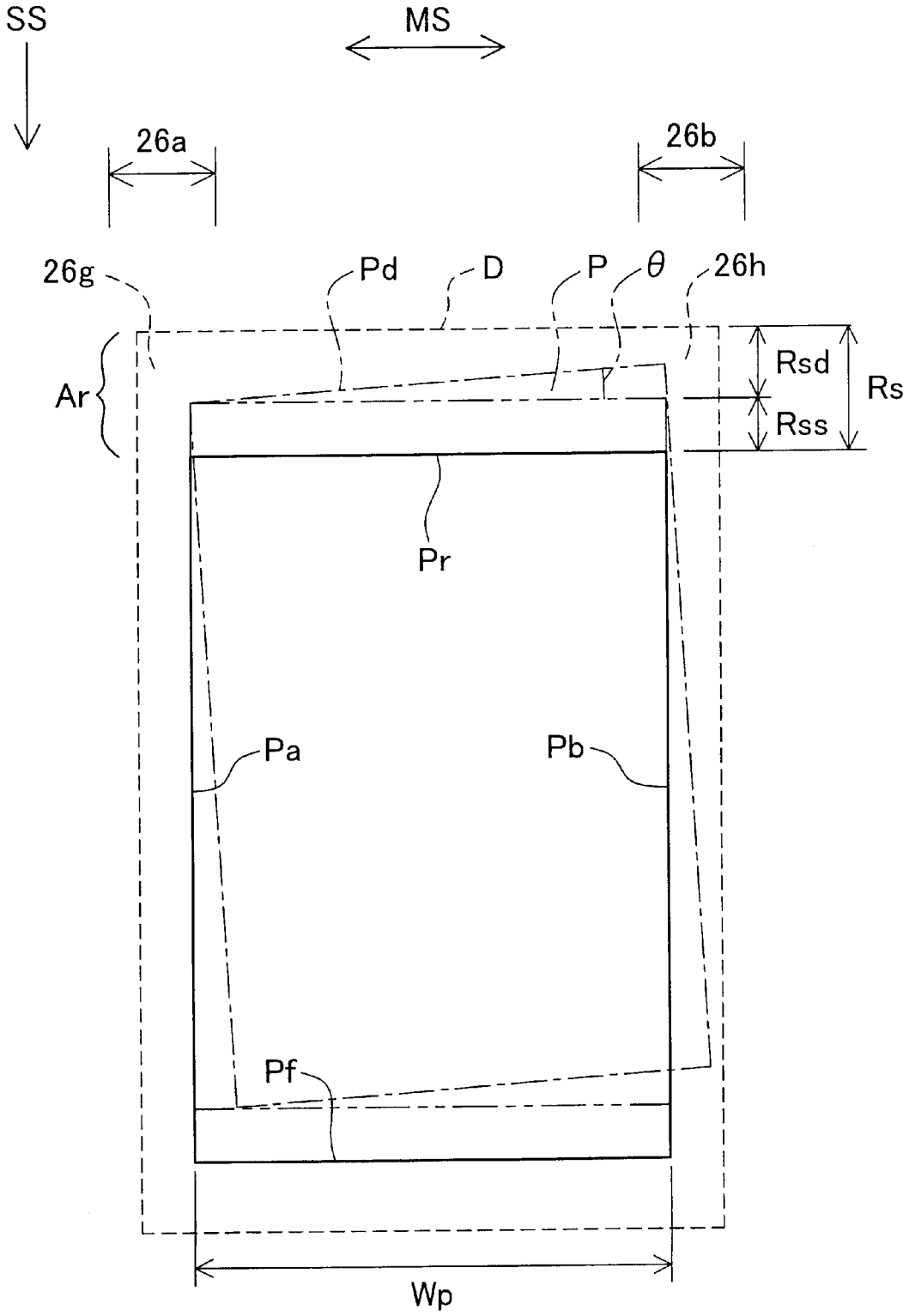
FIG. 16 is a plan view depicting the relation between printing paper P and print images.

FIG. 16 is a plan view depicting the relation between printing paper P and print images. In FIG. 16, the area of the printing paper is indicated by a solid line when the printing paper is in the correct position against the platen 26 the print head 28 or when nozzles are in the correct position against the area where the ink droplets are to be ejected. The area of image to be recorded is indicated by a broken-line. Also shown are the ranges selected for the left slot 26*a* and right slot 26*b* of the platen 26 when the printing paper is in the correct position.

The present embodiment is such that image data D are provided up to the area outside the printing paper P beyond the upper edge Pf of the printing paper P. The image data D are also provided in the same manner up to the areas outside the printing paper P beyond the edges of the printing paper P for the lower edge Pr, left edge Pa, and right edge Pb. The present embodiment is therefore such that the relation between the image data D and the size of the printing paper P, on the one hand, and the intended position of the image data D and the arrangement of the printing paper P during printing, on the other hand, assumes the configuration shown in FIG. 16.

In FIG. 16, the portion of the image data D (shown by a broken like) overlapping the printing paper P is the "area on the print medium", and the area Ar extending beyond the lower edge Pr of the printing paper is the "area extending beyond the rear edge of printing paper". In FIG. 16, the upper edge Pf of the printing paper P is disposed at the bottom of the drawing, and the lower edge Pr is disposed in the top portion of the drawing because the orientation of the printing paper P matches the one shown in FIG. 8.

The length Rs of the image area Ar extending beyond the lower edge Pr of the printing paper P all the way outside the printing paper P is set based on two types of numerical values. The first is dimension Rss, which is determined on the basis of a feed error assumed to occur in the sub-scanning direction when the printing paper P is transported in the direction from its upper edge Pf to its lower edge Pr over the platen 26 by the upstream paper feed rollers 25*a* and 25*b* and the downstream paper feed rollers 25*c* and 25*d*. The second is dimension Rsd, which is determined based on the tilting of the printing paper P assumed to occur when the lower edge Pr of the printing paper P reaches the upstream slot 26*f*. Rss is set to a level greater than the assumed error in the sub-scanning direction, and Rsd is set to a level greater than $Wp \times \sin \theta$, where $\theta°$ is the assumed tilting of the printing paper, and Wp is the width of the printing paper. Specifically, image data D that allow images to be printed all the way to the lower edge Pr of the printing paper P can be prepared even when the printing paper P is tilted or fed incorrectly during sub-scanning. Rss should preferably be set on the basis of a feed error assumed to occur in the sub-scanning direction when the printing paper P is fed in the direction from its upper edge Pf to its lower edge Pr to a point immediately below nozzle No. 45, and Rsd should preferably be set based on the assumed tilting of the printing paper P created when the lower edge Pr of the printing paper P has reached a point immediately below nozzle No. 45. This is because the photoreflector 33*b* is disposed at the same position as nozzle No. 45 in the sub-scanning direction.

The resolution conversion module 97 (see FIG. 2) is a device for converting image data such that images can be printed in designated areas. Rsd and Rss are defined based on the number of main scan lines (that is, the number of dots) and are stored in an expansion area table EAT in accordance with the type and size of printing paper.

FIG. 17 is a table depicting the size Rs of an image area Ar in which ink droplets are ejected beyond the lower edge of printing paper P. The entries in the uppermost row of the table indicate sizes of printing paper (A5–B4). The entries in the left-hand column of the table indicate types of paper (P1–P4). Each cell contains an Rs value in its top half, and Rss and Rsd values (Rss, Rsd) in its lower half. Although the size Rs of the image area Ar (see FIG. 16) in FIG. 17 is defined as the number of main scan lines, it is also possible to define the size Rs in terms of dimensions. These values are stored in the expansion area table EAT of the computer 90.

The misalignment of the lowermost portions of the left and right edges in the sub-scanning direction increases with an increase in the width of printing paper when the printing paper is tilted on the platen, as shown in FIG. 16. In addition, the feed error in the sub-scanning direction increases with an increase in the length of printing paper when the printing paper is transported in the direction from its front end to its back end over the platen 26. For this reason, the size Rs of the image area Ar (which is an area in which ink droplets are ejected further beyond the lower edge of printing paper P) should preferably increase with increased paper width or length. As used herein, the term "paper width" refers to the dimension of the printing paper in the main scanning direction when the printing paper is disposed on the platen 26 during printing, and the term "paper length" refers to the dimension of the printing paper in the sub-scanning direction when the printing paper is disposed on the platen 26 during printing.

The extent to which the downstream paper feed rollers 25*r* and 25*s* slip on the print medium depends on the material of the medium. Consequently, the medium is advanced differently even when the downstream paper feed rollers 25*r* and 25*s* rotate identically during sub-scanning. Consequently, the size of the image area Rs should preferably be increased for print media materials that promote, slippage between the media and the downstream paper feed rollers 25*r* and 25*s*.

Figure 18:
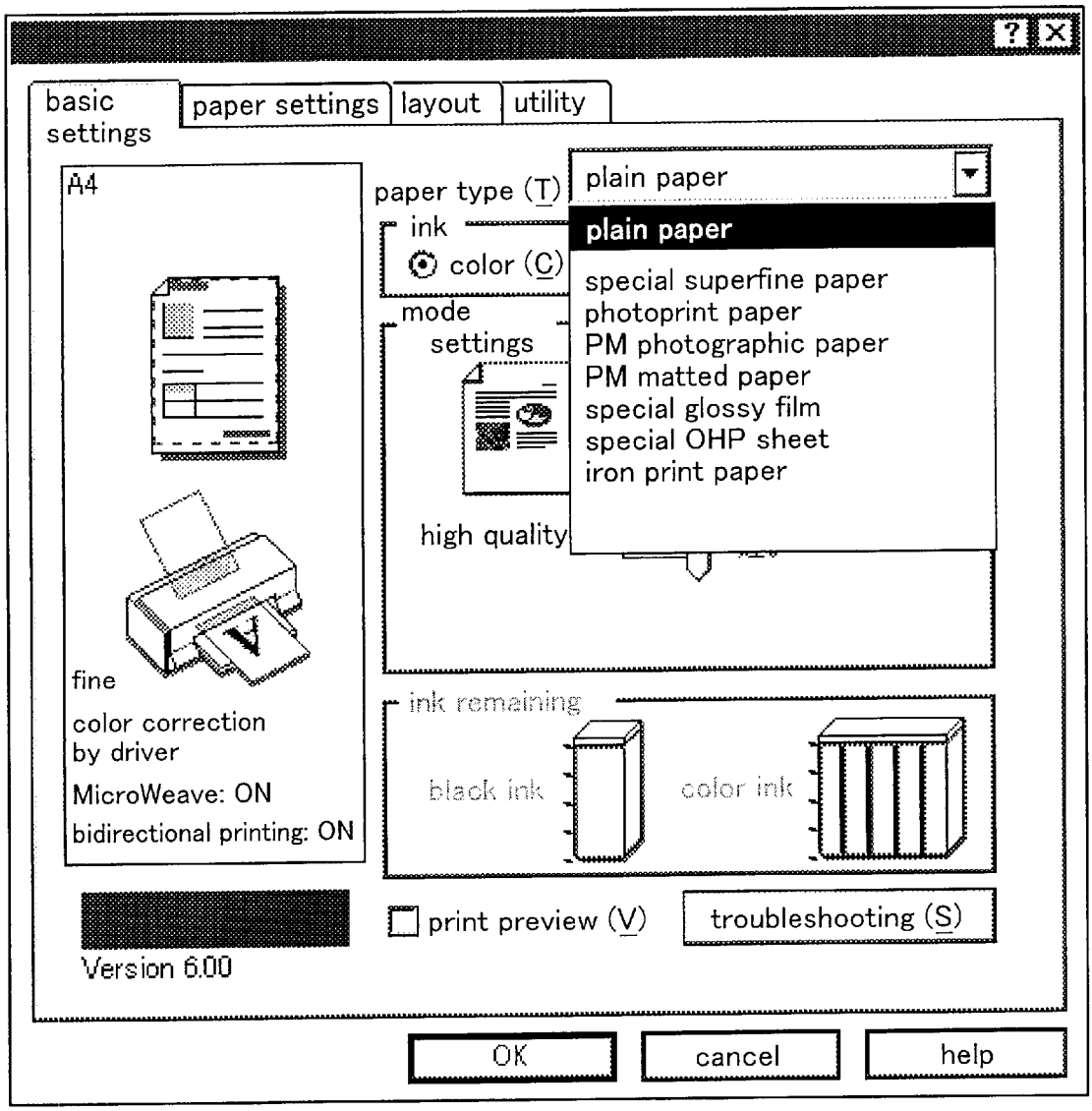
FIG. 18 is a diagram depicting the window for selecting the material of printing paper.
Figure 19:
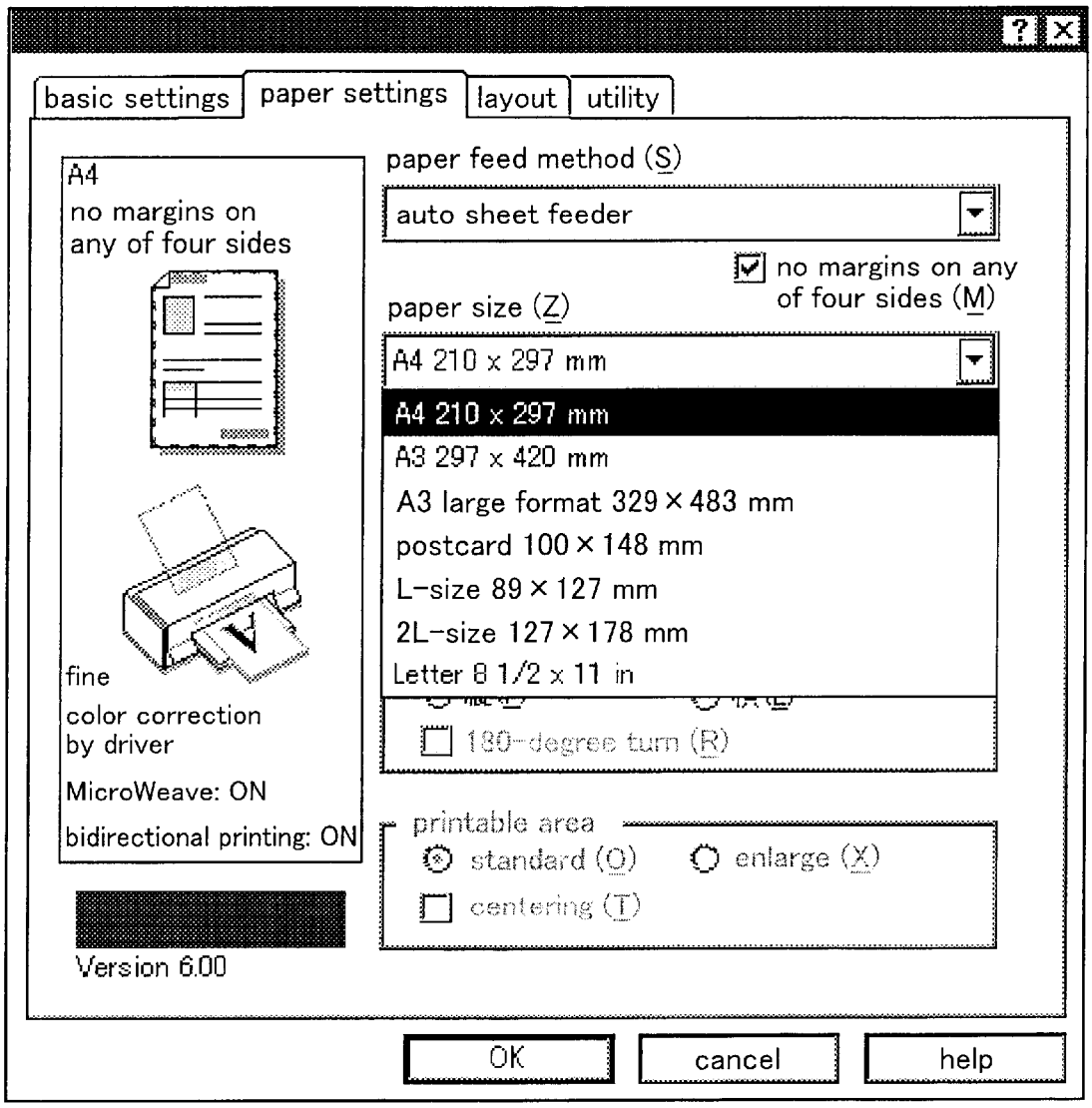
FIG. 19 is a diagram depicting the window for selecting the size of printing paper.

FIG. 18 is a diagram depicting the window for selecting the material of printing paper. FIG. 19 is a diagram depicting the window for selecting the size of printing paper. The size and material of the printing paper are entered into the computer 90 in the following manner prior to printing. When the user sends a print command to the application program 95 in FIG. 2, the application program 95 instructs the printer driver 96 to start printing. When this happens, the printer driver 96 displays a print window on the CRT 21. A window such as the one shown in FIG. 18 is displayed when the user clicks on the "print property" icon in the print window.

The user first selects the "basic settings" tab from among the plurality of tabs available in the window in FIG. 18, and selects the paper type (material) from the "paper type" menu. In the window shown in FIG. 18, "paper type" designates the printing paper material referred to in the present specification. In the case shown in FIG. 18, the plain paper option is selected.

After selecting the print mode, the user selects the second tab ("paper settings"), and selects paper size from the "paper size" menu, as shown in FIG. 19. "A4" is selected in the case shown in FIG. 19.

The user then clicks the "OK" icon in the lower portion of the window in FIG. 19 and clicks the "OK" icon in the "printing" window. At this point, the printer driver 96 initiates a resolution conversion by the resolution conversion module 97 and executes a print routine. A mouse 13 or keyboard 14 (see FIG. 2) can be used by the user to send the commands (selections) to the printer driver 96 via the user interface screen. In other words, the mouse 13 and keyboard 14 function as input devices.

C3. Lower-edge Routine

Figure 20:
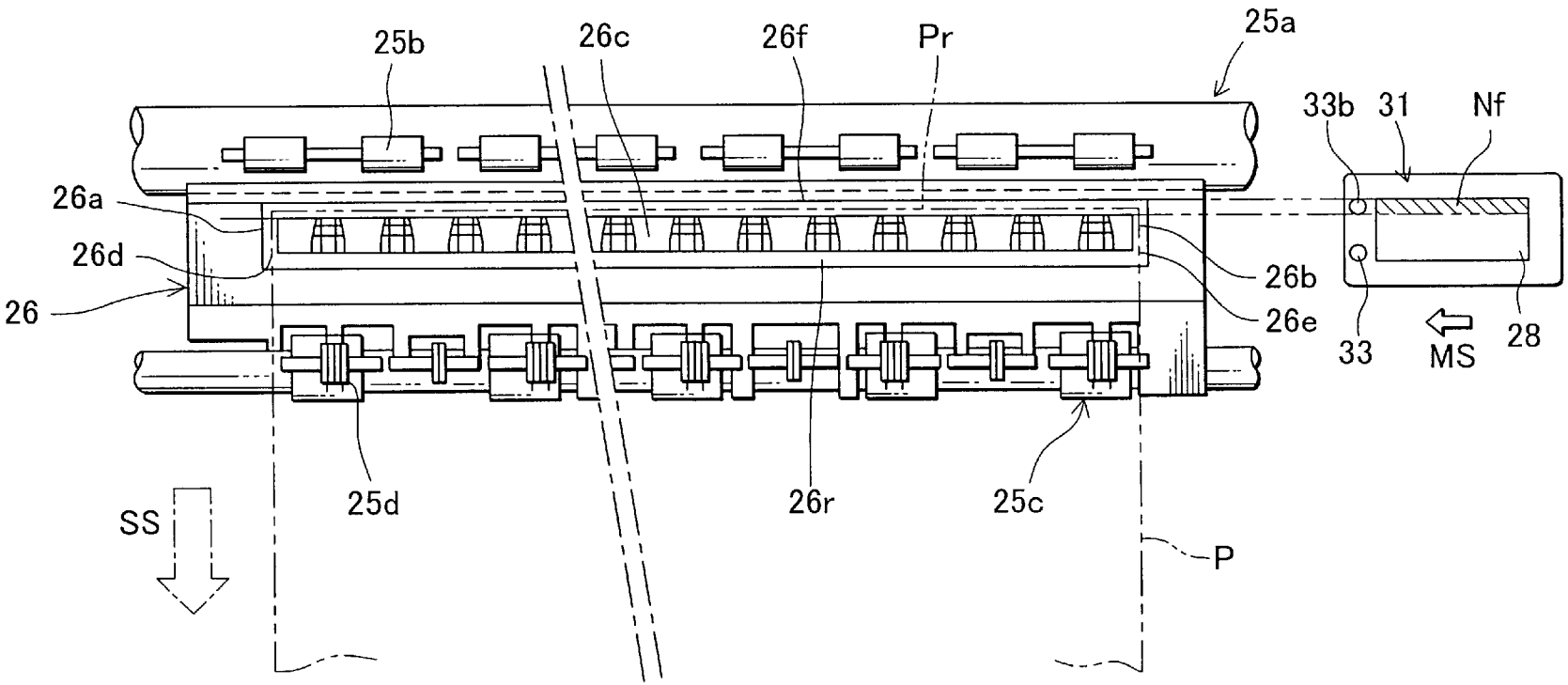
FIG. 20 is a plan view depicting the relation between the printing paper P and an upstream slot 26*f* during printing in the lower-edge portion Pr of the printing paper P.

FIG. 20 is a plan view depicting the relation between the printing paper P and the upstream slot 26*f* during the printing of images in the lower-edge portion Pr of the printing paper P. In the present embodiment, images can be recorded without blank spaces all the way to the lower edge of the printing paper P in the same way as in the case of the upper edge. In FIG. 20, the nozzles Nf in the hatched area of the print head 28 are designed to perform a lower-edge routine. An upstream slot 26*f* is provided underneath the area through which the nozzles travel during main scanning. Images are printed in the lower-edge portion Pr before the printing is completed when the lower edge Pr of the printing paper P is in the position (shown by a dashed line) above the upstream slot 26*f*. In the process, some of the nozzles Nf are disposed upstream (in the sub-scanning direction) from the lower edge (the edge in the upper part of FIG. 13) of the printing paper P.

Figure 21:
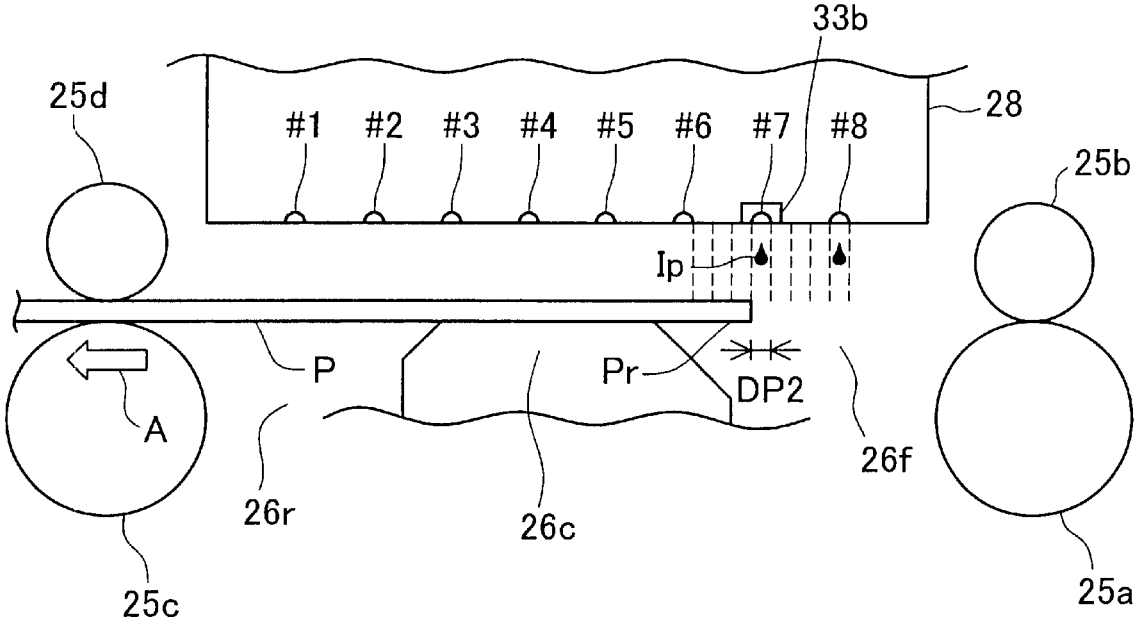
FIG. 21 is a side view depicting the relation between the printing paper P and a print head 28 during printing in the lower-edge portion Pr of the printing paper.

FIG. 21 is a side view depicting the relation between print head 28 and printing paper P during the printing of images on the lower edge Pr of the printing paper. For the sake of convenience, the description will be given with reference to a case in which eight nozzles are used. The arrangement shown in FIG. 21 is configured on the assumption that the photoreflector 33*b* is aligned with nozzle No. 7 in the main scanning direction. Nozzle No. 7 is a nozzle disposed along the downstream end and selected from among the nozzles facing the upstream slot 26*f*. The nozzle group Nf (nozzle Nos. 7 and 8) disposed facing the upstream slot 26*f* prints images on the lower edge Pr of the printing paper P in the same manner as in the first embodiment (see FIG. 20).

Figure 22:
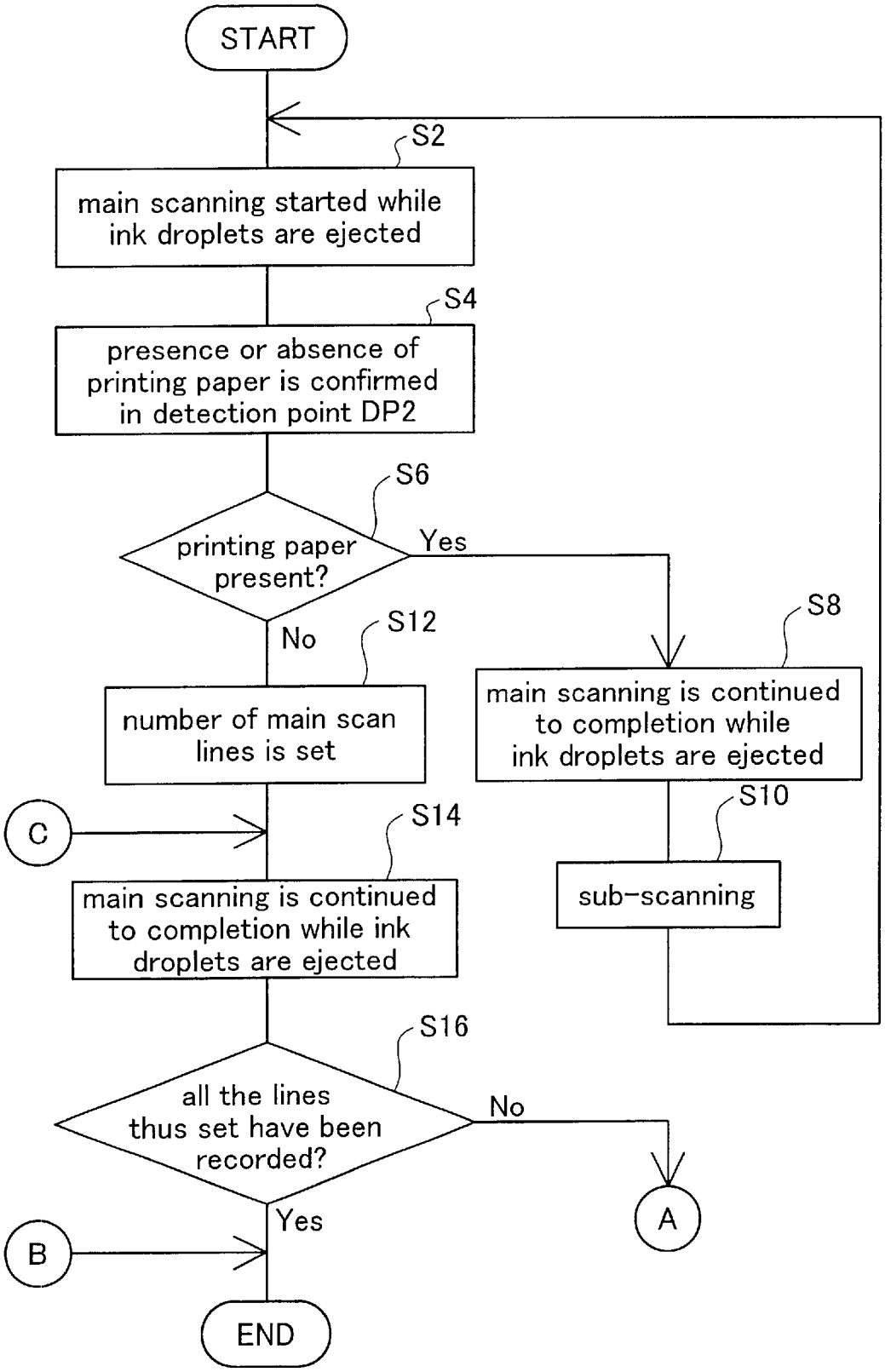
FIG. 22 is a flowchart depicting the printing sequence of a lower-edge routine.
Figure 23:
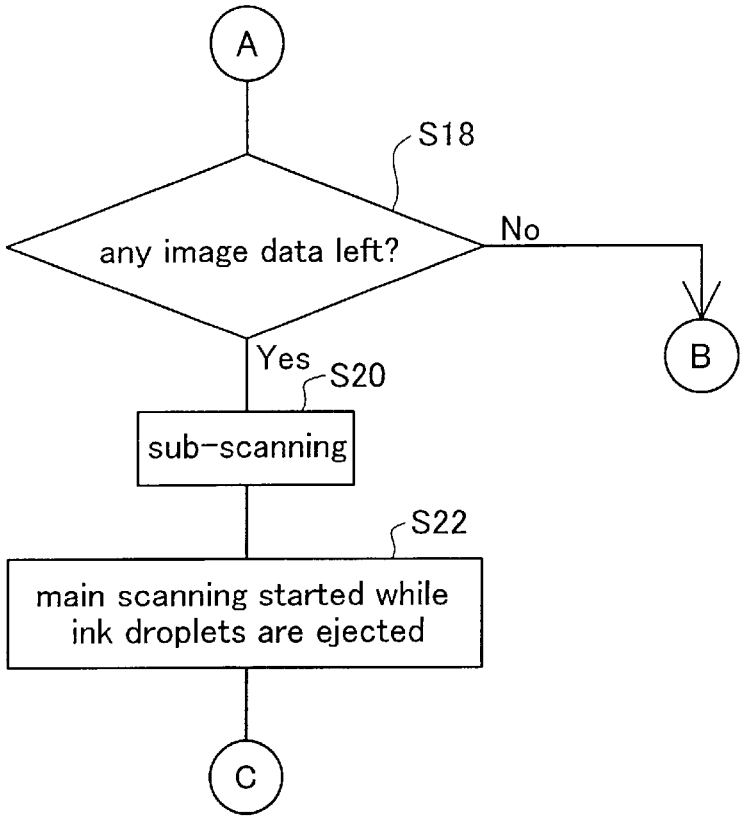
FIG. 23 is a flowchart depicting the printing sequence of a lower-edge routine.

FIGS. 22 and 16 are flowcharts depicting the printing sequence for the lower-edge routine. The CPU 41 feeds the printing paper P to a specific position when a print instruction is issued, and main scanning is started while ink droplets are ejected in step S2. The photoreflector 33*b* confirms the presence of printing paper P at the detection point DP2 during main scanning in step S4 (see FIGS. 2 and 21).

The presence or absence of the printing paper in the detection point DP2 is established in step S6. Main scanning is continued in step S8 if the presence of printing paper has been established, and sub-scanning is performed in step S10 after the main scanning is completed. The main scanning accompanied by the ejection of ink droplets may be performed without interruption during steps S2–S8. The routines of steps S4 and S6 may be performed while such main scanning is executed. Main scanning is restarted in step S2 after the sub-scanning of step S10 is completed. Steps S2–S10 are then repeated in the same manner until the presence of printing paper cannot be confirmed any longer in step S6.

If the printing paper is absent in step S6, that is, if it is confirmed that the lower edge of the printing paper has moved beyond the detection point DP2 (see FIG. 21), the CPU 41 determines the number of main scan lines in which dots are to be recorded in the subsequent step S12, and the information about these main scan lines is stored in RAM 43 (see FIG. 3). In the process, the CPU 41 defines the manner in which the dots are recorded in the main scan lines that correspond to the length Rsd shown in FIG. 16. Rsd data are included in print data PD, which is sent to the printer 22. In step S12, it is determined whether the lower edge Pr of the printing paper P has moved past the detection point DP2 in the immediately preceding step S4. Specifically, it is determined in step S12 whether the lower edge Pr of the printing paper P is at a specific position downstream from DP2 when the number of main scan lines is established for dot recording. It is therefore possible to select the required number of main scan lines in step S12 by taking into account solely the tilting of the printing paper, without any need to take into account the feed error heretofore created in the sub-scanning direction (see FIG. 16). In the example shown in FIG. 21, dots are printed over an area covered by three more main scan lines after the photoreflector 33*b* confirms that the lower edge of the printing paper P has passed.

The main scanning started in step S2 is continued in step S14 after step S12 is completed. When the main scanning is completed, it is determined in step S16 whether recording specified in step S12 is completed for all main scan lines. The main scanning accompanied by the ejection of ink droplets may be performed without interruption during steps S2–S14. Such main scanning accompanies the routines performed in steps S4, S6 and S12.

If it is determined in step S16 that unrecorded main scan lines still remain, it is then determined in step S18 (FIG. 22) that some image data are still available for recording dots on unrecorded main scan lines. Sufficiently massive image data D are made available to allow images to be recorded all the way to the lower edge Pr of the printing paper by taking into account the feed error in the sub-scanning direction and the tilting of the printing paper, as described with reference to FIG. 16. Specifically, a feed error generated during sub-scanning is likely to remain within the designated range of Rss values (see FIG. 16) in cases in which the lower edge Pr of the printing paper P is detected in step S4, and the aforementioned error is generated before the routines that follow step S12 are carried out. In addition, the image data are unlikely to be lost when dots are printed across the width Rsd after the lower edge Pr of the printing paper has been detected at the detection point DP2. There are, however, cases in which the previously created feed error of sub-scanning exceeds Rss as a result of an unforeseen accident. In such cases, the image data are lost before recording is completed for all the main scan lines defined in step S12 and selected in correspondence with Rsd. It is determined in such cases that the image data are lost, and the routine is completed in step S18.

If it is determined in step S18 that some image data remain, sub-scanning is performed in step S20, and main scanning is restarted in step S22. Routine S14 and subsequent routines are then performed. The routines of steps S20, S22, and S14 are repeated when the recording defined in step S12 is completed for all the designated main scan lines, excluding cases in which it is determined in step S18 that the image data have been lost. The main scanning accompanied by the ejection of ink droplets may be performed without interruption during steps S22–S14.

Figure 24:
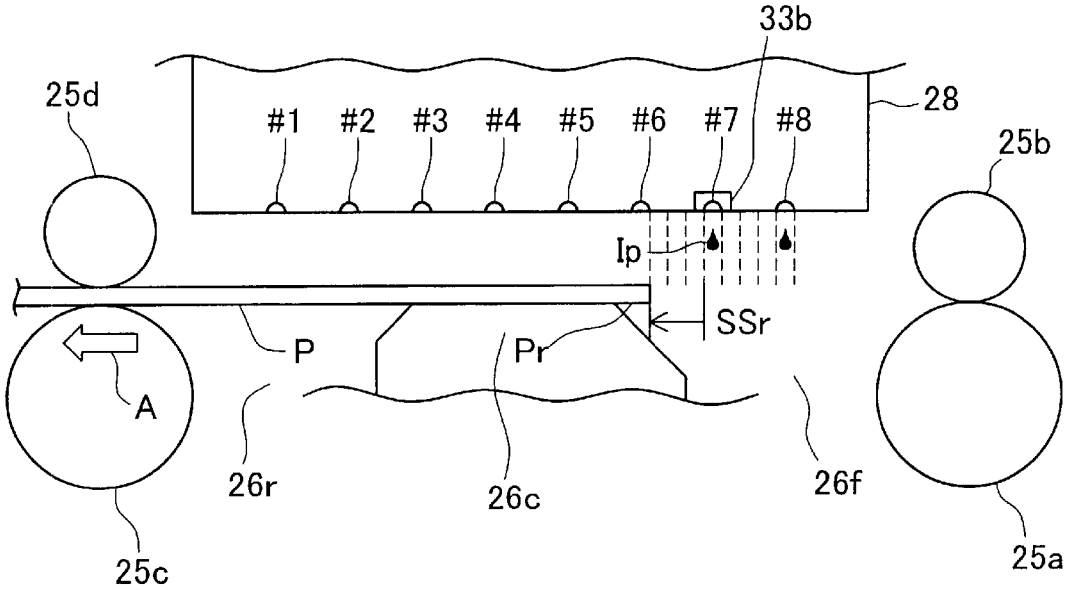
FIG. 24 is a side view depicting the relation between the print head 28 and the printing paper P existing immediately before printing is completed.

FIG. 24 is a side view depicting the relation between the print head 28 and the printing paper P existing immediately before printing is completed. In the examples shown in FIGS. 21 and 24, the printing paper P is advanced through three main scan lines in the direction of arrow SSr while the routines of steps S16, S20, S22, and S14 are repeated, and main and sub-scanning is performed in the meantime in conjunction with the ejection of ink droplets. Printing is completed in step S16 when it is determined that recording has been completed for all the main scan lines selected in step S12. The corresponding condition is shown in FIG. 24.

C4. Merits

In the lower-edge routine, the lower edge Pr of the printing paper P is placed over the upstream slot 26*f* when images are to be printed on the lower edge Pr of the printing paper P. The images are printed on the lower edge Pr of the printing paper P by nozzle No. 7, which is disposed directly above the lower edge Pr, and nozzle No. 8, which is disposed upstream from the lower edge Pr of the printing paper P. Images can therefore be printed without blank spaces on the rear edge Pr of the printing paper. In addition, positioning nozzle Nos. 7 and 8 above the upstream slot 26*f* prevents ink droplets from depositing in the central portion 26*c* of the platen 26.

The printing paper is likely to have left the area underneath nozzle Nos. 7 and 8 when it is determined that the printing paper P is not at the detection point DP2 any longer, as shown in FIG. 21. Specifically, it is likely that the printing of the lower edge Pr is completed. Consequently, images can theoretically be recorded without blank space all the way to the lower edge of the printing paper when printing is completed at this stage.

When, however, the printing paper P is tilted on the platen, the printing paper P can still be found in the same position in the sub-scanning direction on the side of the right slot 26*b*, even in cases in which the printing paper P cannot be detected at the detection point DP2 on the left slot 26*a*. In other words, blank spaces may be left on the lower edge Pr of the printing paper P when the printing operation is completed at this time. The same problem may occur when the upper left corner of the printing paper is torn off or folded over. With the present embodiment, however, images continue to be printed across the width Rsd on the basis of the area D defined by image data when the lower edge of the printing paper P is disposed downstream of nozzle Nos. 7 and 8, which are used for printing. The printing of images on the lower edge Pr of the printing paper P is completed when the lower edge of the printing paper P is disposed downstream of the detection point DP2 (see FIGS. 21 and 24). Blank spaces are thus unlikely to form on the lower edge of the printing paper when the printing paper P is tilted on the platen and is partially torn or folded.

Images can also be printed without blank spaces on the lower edge Pr of printing paper with the aid of a printer devoid of the photoreflector 33*b* in the vicinity of the upstream nozzle group Nf. This can be achieved by printing the images on the lower edge Pr when the lower edge of the printing paper P is disposed downstream of the upper-edge nozzles in the same manner as in FIG. 21. With such a printer, however, the position of the printing paper P cannot be detected in the period that starts with confirming that the upper edge Pf of the printing paper P has reached the detection point DP (see FIG. 9) and ends with the printing paper passing through a position facing the nozzle group Nf. It is, however, possible that a feed error will be created during sub-scanning in the period that starts with the upper edge Pf of the printing paper P reaching the detection point DP inside the downstream slot 26*r* and ends with the lower edge Pr reaching a point above the upstream slot 26*f* (see FIG. 20). It is therefore preferable in the case of such printers to select the printing range by taking into account the feed error of sub-scanning created after the position of the printing paper has been detected when size Rs is defined for the area Ar in which images are to be printed beyond the lower edge of the printing paper. Specifically, images can be printed across all ranges of the image data D shown in FIG. 16. The data are defined based on dimension Rss, which relates to the feed error, and dimension Rsd, which relates to the tilting of the printing paper P. As a result, printing can be continued even after the lower edge of the printing paper has actually passed above the upstream slot 26*f* and images have been printed in an area corresponding to the width Rsd (defined in the assumption that the printing paper is tilted) when the paper is fed excessively during sub-scanning after the position of the printing paper has been confirmed.

By contrast, the present embodiment is configured such that it is first determined whether the lower edge of the printing paper P has moved past a detection point DP2 (which is the downstream end of the area containing the nozzle group Nf), and printing is then completed after being performed across a given width (that is, a given number of main scan lines). Specifically, printing is completed after being continued for the width Rsd after it has been confirmed that the lower edge of the printing paper P is disposed at the detection point DP2. Not all the images of image data D are necessarily printed.

Because the present embodiment entails actually detecting the lower edge of printing paper, there is no need to take into account the feed error of sub-scanning (created in the period that starts with the upper edge Pf of the printing paper P reaching the detection point DP and ends with the lower edge Pr reaching the upstream slot) when images are printed beyond the lower edge of the printing paper. It is therefore possible to reduce the size of an image area in which ink droplets are ejected during printing and which is set beyond the lower edge of the printing paper. As a result, the time needed for printing can be reduced and less ink can be wasted as droplets that are ejected without landing on the printing paper.

When images are printed in the middle portion of printing paper, it is unlikely that the ink will land outside the upper edge Pf or lower edge Pr of the printing paper P, so it is preferable to perform high-speed printing by employing other nozzles provided to the print head. Once the images have been printed in the medium portion of printing paper, the printing operation is continued for the lower edge of the printing paper, which is disposed on the upstream side in the sub-scanning direction. It is therefore possible to achieve a smooth transition without resorting to reverse feeding when a switch is made from printing in the middle portion of printing paper to printing on the rear edge by adopting an approach in which images are printed on the lower edge of printing paper by a nozzle group Nf disposed along the upstream edge.

D. Third Embodiment

Figure 25:
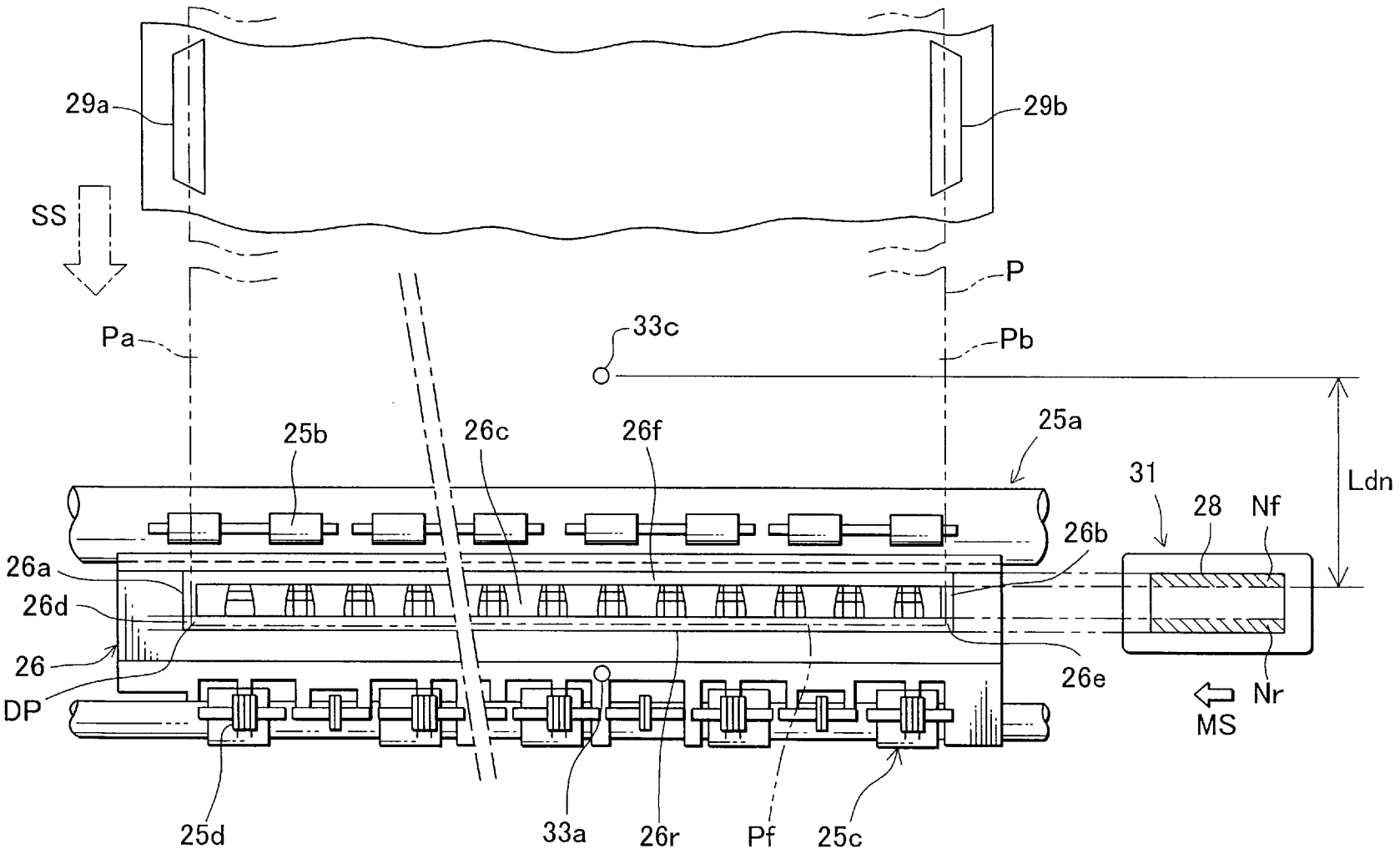
FIG. 25 is a plan view depicting the periphery of a platen 26 according to the third embodiment.

FIG. 25 is a plan view depicting the periphery of a platen 26 in the third embodiment. In the second embodiment, the photoreflector working as the detector is mounted on the carriage 31. The detector may be mounted on other parts of the printer 22. In the third embodiment, a photoreflector 33*a* as the detector is mounted further downstream (in the sub-scanning direction) from the position in which the carriage 31 moves back and forth during main scanning. A photoreflector 33*c* as the detector is mounted further upstream from the position in which the carriage 31 moves back and forth during main scanning. Other constructions of printer in the third embodiment is the same as that of the printer 22 in the second embodiment.

According to the third embodiment, a print medium can be accurately positioned, dots recorded, and images formed on the print medium by confirming the presence of the print medium with a photoreflector 33*a*. In this arrangement, however, the printing paper must be fed in the direction opposite from the ordinary direction (that is, must be fed upstream in the sub-scanning direction) in cases in which the upper-edge routine of the printing paper is disposed above a slot, and images are printed without blank spaces all the way to the upper edge of the printing paper by the nozzles above this slot.

Another feature of the third embodiment is that printing is started after the printing paper is disposed such that the upper edge of the print medium is placed in an arbitrary position. This is achieved by adopting a method in which the medium is fed over a specific distance in the sub-scanning direction, and printing is started after the presence of printing paper is confirmed by a photoreflector 33*c* (the front edge of printing paper is detected by the photoreflector 33*c*). It is therefore possible to feed the printing paper in the sub-scanning direction until the upper edge of the printing paper reaches a point above the slot following the detection of the printing paper, and to print images in the edge portion with nozzles disposed above the slot after this state is established.

When the lower edge of printing paper is above the slot, images can be printed in the edge portion by the nozzles facing the slot by adopting a procedure in which the print medium is fed over a specific distance in the sub-scanning direction, and the printing operation is completed by the printing of images during such scanning after the photoreflector 33*c* can no longer detect the presence of printing paper (that is, it is confirmed that the rear edge of the printing paper has passed the designated point). The following equation is used in this case to calculate the length of the image area in the sub-scanning direction in which ink droplets are further ejected after the lower edge of the printing paper P has passed the detection point, that is, the number of main scan lines Rsp on which images are recorded after the detector can no longer detect the presence of the print medium.

$$Rsp=Ldn+(Rss\times Ldn/L)+Rsd \quad (1)$$

where Ld is the distance from the detection point of the photoreflector 33*c* to the farthest downstream nozzle used for the lower-edge routine; L is the length of printing paper P; Rss is a dimension established based on the error of sub-scanning, itself assumed to occur when the farthest downstream nozzle used for the lower-edge routine passes over the printing paper P from its front edge to its rear edge; and Rsd is a dimension established based on the expected tilting of the printing paper P. It is assumed that each of the values is defined in terms of dot numbers.

It is thus possible to achieve the goal of detecting the print medium with a simple structure and to create a more compact device by mounting a sensor downstream or upstream (in the sub-scanning direction) from the position through which the carriage 31 moves back and forth during main scanning. In addition, placing the detector near the center of the printable area in the main scanning direction in the manner shown in FIG. 25 makes it possible to reduce the distance between the position of the paper edge sensed by the detector and the farthest actual position assumed by the paper edge due to a misalignment caused by paper tilting.

In the second embodiment, a photoreflector 33*b* was mounted as a detector on the carriage 31, so the presence or absence of printing paper was confirmed in step S4 following the start of main scanning in step S2 in accordance with the printing sequence shown in FIG. 22. An alternative is to confirm the presence or absence of printing paper before or after a main scan by adopting an approach in which the detector is fixedly mounted relative to the platen 26, and the presence or absence of printing paper is confirmed along the travel path. When the presence of printing paper is confirmed before a main scan, the printing sequence is modified such that step S2 is excluded from the routine of FIG. 22, and the main scan is started and completed in step S8.

E. Modifications

The present invention is not limited by the above-described embodiments or embodiments and can be implemented in a variety of ways as long as the essence thereof is not compromised. For example, the following modifications are possible.

E1. Modification 1

In the present embodiment, the carriage 31 was provided with a single sensor. It is also possible, however, to mounts sensors at other locations inside the printer 22. For example, a sensor can be mounted independently from the carriage 31 at a location that is farther away from the platen than the space through which the carriage 31 travels during main scanning. Adopting such an embodiment makes it possible to detect the presence of printing paper at the detection point without moving the carriage 31. The system is thus prevented from being affected when a dimensional error pertaining to the carriage position occurs during main scanning. A plurality of sensors designed for different detection points may also be provided. Providing sensors both above the left slot and about the right slot makes it possible to detect the presence of printing paper even if it shifts in either direction during main scanning or it tilts.

The sensors may also travel along the sliding shaft 34 independently from the movement of the carriage 31. Images can be printed unimpeded if the sensors are moved during printing in a manner that excludes interference between the carriage and the sensors. Adopting such an embodiment can reduce printer dimensions in the height direction in comparison with an embodiment in which a sensor is mounted at a position disposed farther from the platen than the aforementioned carriage 31.

Figure 26:
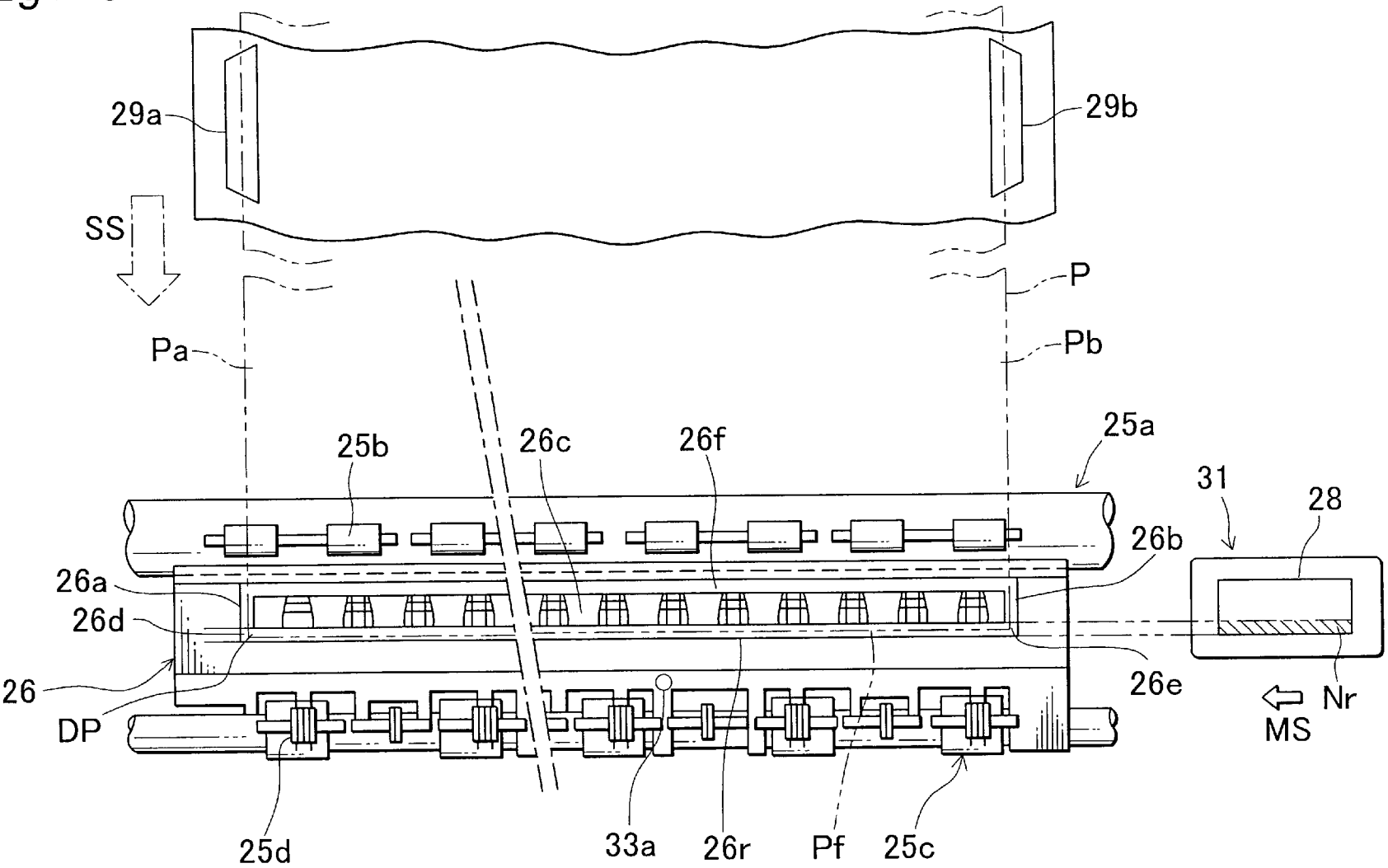
FIG. 26 is a plan view depicting the periphery of a modified platen 26.
Figure 27:
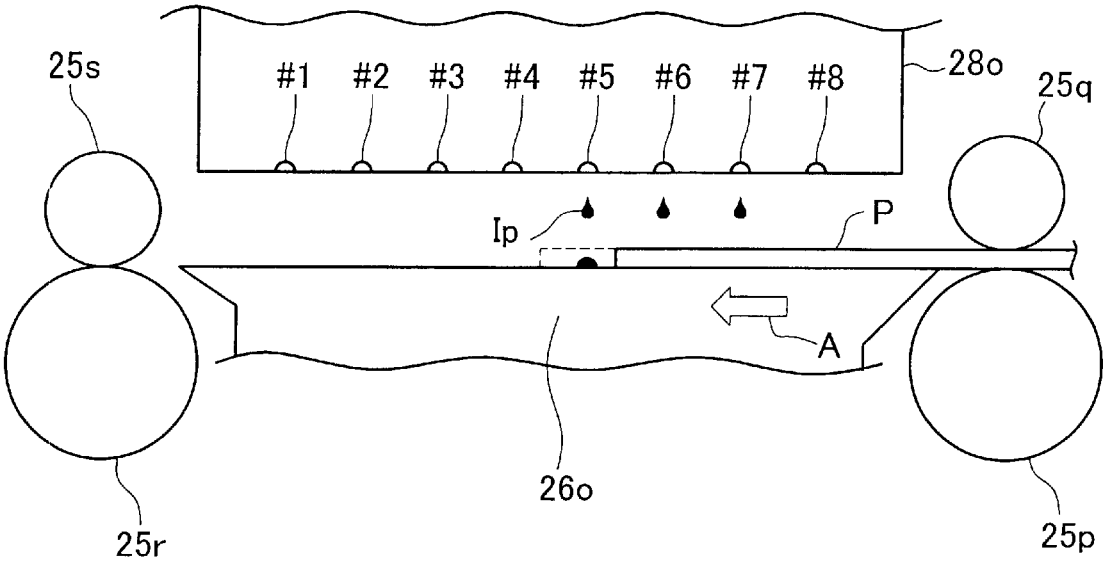
FIG. 27 is a side view depicting the periphery of a print head for a conventional printer.

FIG. 26 is a plan view depicting the periphery of a modified platen 26. A sensor is mounted further downstream (in the sub-scanning direction) from the position in which the carriage 31 moves back and forth during main scanning. In this embodiment as well, the print medium is accurately positioned for recording dots and forming images on the recording medium as a result of the fact that the sensor (photoreflector 33*a*) detects the presence of the print medium. In this embodiment, however, the printing paper must be fed upstream in the sub-scanning direction (which is opposite from the direction in which printing paper is normally fed) when the upper-edge portion of the printing paper is placed above a slot, and the nozzles above this slot are used to print images without blank spaces along the upper edge of the printing paper.

According to yet another embodiment, a sensor is mounted further upstream (in the sub-scanning direction) from the position in which the carriage 31 moves back and forth during main scanning. In this embodiment, printing paper is arranged such that the upper edge of the print medium reaches an arbitrary position and printing is started after the presence of the printing paper is detected by the sensor and the paper is fed by a specific amount in the course of sub-scanning. It is thus possible to perform sub-scanning such that the upper edge of the printing paper reaches a point about the slot after the printing paper has been detected, and images are printed along the edge portion in this state by the nozzles disposed above the slot. It is thus possible to achieve the goal of detecting the print medium with a simple structure and to create a more compact device by mounting a sensor downstream or upstream (in the sub-scanning direction) from the position through which the carriage 31 moves back and forth during main scanning.

E2. Modification 2

In the first to third embodiments, the point where the printing paper is detected is one point DP or DP2. But two or more detecting points may be set along the main scanning direction. The detecting area may be set along the main scanning direction. In the case that the detector is mounted on the carriage as shown in FIG. 2, printing paper can be detected during main scan, for example, between DP2 and DP3. In this embodiment, the position of the printing paper can be detected more precisely.

E3. Modification 3

The above embodiments entail performing both an upper-edge routine and a lower-edge routine, but either of these may also be performed alone as needed. It is also possible to dispense with the upper- and lower-edge routines altogether. The printing devices of the above embodiments were each provided with a left slot 26*a* and a right slot 26*b* on the left and right sides, and with an upstream slot 26*f* and downstream slot 26*r* on the upstream and downstream sides, respectively, of the platen 26 (in the sub-scanning direction), but either of these may be selectively provided as well. The preferred option in such cases would be to print images solely in the edge portion of the printing paper P provided with a slot, and to print images with the aid of nozzles disposed above corresponding slots. Another possible option would be to accurately position a printing paper P on a platen devoid of any slots, to provide blank spaces at the four corners, and to print images at the exact locations on the printing paper P.

E4. Other

In the above embodiments, software can be used to perform some of the functions carried out by hardware, or, conversely, hardware can be used to perform some of the functions carried out by software. For example, a host computer 90 can be used to perform some of the functions carried out by the CPU 41 (FIG. 4).

The computer programs for performing such functions may be supplied as programs stored on floppy disks, CD-ROMs, and other types of computer-readable recording media. The host computer 90 may read the computer programs from these recording media and transfer the data to internal or external storage devices. Alternatively, the computer programs can be installed on the host computer 90 from a program-supplying device via a communications line. Computer programs stored by an internal storage device are executed by the host computer 90 when the functions of the computer programs are to be performed. Alternatively, computer programs stored on a storage medium may be executed directly by the host computer 90.

As used herein, the term "host computer 90" refers both to a hardware device and to an operating system, and designates a hardware device capable of operating under the control of an operating system. Computer programs allow such a host computer 90 to perform the functions of the above-described units. Some of the aforementioned functions can be performed by an operating system rather than an application program.

As used herein, the term "computer-readable recording medium" is not limited to a portable recording medium such as a floppy disk or a CD-ROM and includes various RAMs, ROMs, and other internal computer storage devices as well as hard disks and other external storage devices fixed to the computer.

What we claimed is:

1. A dot-recording method for recording ink dots on a surface of a print medium using a dot-recording device, comprising the steps of:

(A) providing a dot-recording head provided with a plurality of dot-forming elements for ejecting ink droplets; and a sensor for detecting presence of the print medium at a specific detection point, the sensor being disposed at a point outside paths of the ink droplets ejected by the plurality of dot-forming elements during the main scanning, and upstream in the sub-scanning direction of a dot-forming element that is located on the downstream end in the sub-scanning direction among the dot-forming elements used for dot recording;

(B) preparing image data that allow images to be printed in an image area comprising an area on the print medium and an area extending beyond the rear edge of the print medium;

(C) performing dot recording according to the image data while performing the main scanning and the sub-scanning; and (D) detecting the rear edge of the print medium on the detection point by the sensor, continuing the dot recording according to the image data until the sub-scanning is performed for a predetermined distance after the detecting, to thereby complete the dot recording on the print medium.

2. A dot-recording method as defined in claim 1, wherein the step (E) comprises the step of selecting the predetermined distance according to material of the print medium.

3. A dot-recording device as defined in claim 1, wherein the step (E) comprises the step of selecting the predetermined distance according to size of the print medium.

4. A dot-recording method as defined in claim 1, wherein the dot-recording device comprises a platen configured to support the print medium, the platen extending in the main scanning direction, being disposed opposite the dot-forming elements at least along part of the main scan path and having a slot, the slot extending in the main scanning direction, a width of the slot in the sub-scanning direction corresponding to a specific sub-scanning range on a surface of the dot recording head including at least part of the plurality of dot-forming elements; and steps (B) and (D) include a step for confirming the presence or absence of the print medium at a detection point, the detection point being located inside the slot and within a sub-scanning range containing the plurality of dot-forming elements.

5. A dot-recording method as defined in claim 4, the step (D) comprises the step of detecting the print medium at the detection point that is in a vicinity of a dot-forming element and is at a downstream end in the sub-scanning direction.

6. A computer program product for recording ink dots on a surface of a print medium using a computer, the computer equipped with a dot-recording device, the dot-recording device being provided with a dot-recording head and a sensor, the dot-recording head being provided with a plurality of dot-forming elements for ejecting ink droplets, the sensor being configured to detect presence of the print medium at a specific detection point, the sensor being disposed at a point outside paths of the ink droplets ejected by the plurality of dot-forming elements during the main scanning, the computer program product comprising:

a computer readable medium; and a computer program stored on the computer readable medium, the computer program comprising:

a sub-scanning starting program for causing the computer to start a sub-scan feed of the print medium from a state in which the print medium is absent from the detection point;

a sub-scanning stopping program for causing the computer to stop the sub-scan feed of the print medium at a specific position of sub-scanning associated with a position where the sensor detects the presence of the print medium; and a dot-forming starting program for causing the computer to start main scanning and eject ink droplets from the dot-forming elements after the print medium reaches the specific position of sub-scanning.

7. A computer program product as defined in claim 6, the sub-scanning stopping program comprises a detecting program for causing the computer to detect the print medium at the detecting point that is in the vicinity of a dot-forming element in a sub-scanning direction and is at a downstream end in the sub-scanning direction among the dot-forming elements used for printing.

8. A computer program product for recording ink dots on a surface of a print medium using a computer, the computer equipped with a dot-recording device, the dot-recording device being provided with a dot-recording head and a sensor, the dot-recording head being provided with a plurality of dot-forming elements for ejecting ink droplets, the sensor being configured to detect the presence of the print medium at a specific detection point, the sensor being disposed at a point outside paths of the ink droplets ejected by the plurality of dot-forming elements during the main scanning, and upstream in the sub-scanning direction of a dot-forming element that is located on the downstream end in the sub-scanning direction among the dot-forming elements used for dot recording; the computer program product comprising:

a computer readable medium; and a computer program stored on the computer readable medium, the computer program comprising:

an image data generating program for causing the computer to generate image data that allow images to be printed in an image area comprising an area on the print medium and an area extending beyond the rear edge of the print medium;

a dot forming program for causing the computer to perform dot recording according to the image data while performing the main scanning and the sub-scanning; and a dot forming completing program for causing the computer to detect the rear edge of the print medium on the detection point by the sensor, to continue the dot recording according to the image data until the sub-scanning is performed for a predetermined distance after the detecting, to thereby complete the dot recording on the print medium.

9. A computer program product as defined in claim 8, wherein the computer program further comprises a sub-scanning setting program for causing the computer to set the predetermined distance according to material of the print medium.

10. A computer program product as defined in claim 8, wherein the computer program further comprises a sub-scanning setting program for causing the computer to set the predetermined distance according to size of the print medium.

11. A computer program product as defined in claim 8, wherein the dot-recording device further comprises a platen configured to support the print medium, the platen extending in the main scanning direction, the platen being disposed opposite the dot-forming elements at least along part of a main scan path and having a slot, the slot extending in the main scanning direction, a width of the slot in the sub-scanning direction corresponding to a specific sub-scanning range on a surface of the dot recording head including at least part of the plurality of dot-forming elements; the computer program further comprises a detecting program for causing the computer to detect the print medium at the detection point that is inside the slot and within a sub-scanning range containing the plurality of dot-forming elements.

12. A computer program product as defined in claim 11, wherein the dot forming completing program comprises a pass detecting program for causing the computer to detect the rear edge of the print medium on a point that is in a vicinity of a dot-forming element that is located at a downstream end in the sub-scanning direction.

* * * * *